US005895152A

United States Patent [19]

Ide et al.

[11] Patent Number: 5,895,152

[45] Date of Patent: Apr. 20, 1999

[54] FIXING DEVICE AND FIXING TEMPERATURE CONTROL METHOD

[75] Inventors: Atsushi Ide, Nara; Kazumi Irie, Yamatokoriyama; Yoritaka Tsubaki, Yamatokoriyama; Masao Yamamoto, Yamatokoriyama; Hideo Matsuda, Nara, all of Japan

[73] Assignee: Sharp Kabushiki Kaisha, Osaka, Japan

[21] Appl. No.: 08/968,288

[22] Filed: Nov. 12, 1997

[30] Foreign Application Priority Data

Nov. 13, 1996 [JP] Japan ..... 8-301517
Nov. 21, 1996 [JP] Japan ..... 8-310241

[51] Int. Cl.[6] ..... G03G 15/20

[52] U.S. Cl. ..... 399/322; 399/329; 219/216

[58] Field of Search ..... 399/67–70, 329, 399/322, 332, 328; 219/216; 430/124, 126

[56] References Cited

U.S. PATENT DOCUMENTS

| | | | |
|---|---|---|---|
| 5,053,829 | 10/1991 | Field et al. | 399/329 |
| 5,339,146 | 8/1994 | Aslam et al. | 399/342 |
| 5,666,623 | 9/1997 | Yamada et al. | 399/320 |
| 5,671,473 | 9/1997 | Yamada et al. | 399/320 |
| 5,771,434 | 6/1998 | Hokari | 399/400 |

FOREIGN PATENT DOCUMENTS

| | | |
|---|---|---|
| 3-198080 | 8/1991 | Japan . |
| 06318001 | 11/1994 | Japan . |
| 9-197735 | 7/1997 | Japan . |

*Primary Examiner*—Matthew S. Smith
*Attorney, Agent, or Firm*—Dike, Bronstein, Roberts & Cushman, LLP; David G. Conlin

[57] ABSTRACT

Since the paper entry guide is disposed below and in close proximity to a fixing belt, the leading edge of recording paper can become wavy or curled when operated in a high temperature, high humidity environment or when printing on the reverse side of the paper in double-sided print mode, and this has lead to the problem that the leading edge of the recording paper after transfer is not properly inserted in the narrow spacing between the paper entry guide and the fixing belt, resulting in a recording paper jam. A fixing device comprises a fixing belt stretched around a heating roller with a heat source contained therein and a fixing roller, a pressing roller for pressing the fixing roller from below via the fixing belt, and a paper entry guide disposed below and in close proximity to the fixing belt and upstream of a nipping portion composed of the fixing belt and the pressing roller. The paper entry guide is pivotably supported on a fulcrum. A solenoid is provided at the upstream side of the paper entry guide, and a return spring is disposed above the paper entry guide. The solenoid, when in the ON state, pulls a plunger to its lowermost position against the spring force of the return spring, and thereby rotates the paper entry guide in the clockwise direction about the fulcrum to maintain spacing with respect to the fixing belt.

10 Claims, 24 Drawing Sheets

FIXING DEVICE AND FIXING TEMPERATURE CONTROL METHOD

BACKGROUND OF THE INVENTION

1. Field of the Invention

The present invention relates to a fixing device and a fixing temperature control method for image forming apparatuses such as copying machines and various types of printers. More particularly, the invention relates to a fixing device having a paper entry guide disposed below and in close proximity to an endless fixing belt which is passed around a heating roller and a fixing roller and conveys recording paper to a nipping portion composed of the fixing roller and a pressing roller in order to achieve image fixing by sandwiching the recording paper between the fixing roller and the pressing roller via the fixing belt, and also relates to a fixing temperature control method for use with such a fixing device.

2. Description of the Related Art

Traditionally, for an electrophotographic-type fixing device, a heat roller method has often been used wherein a pair of upper and lower rollers coated with a nonadhesive material such as a fluorine resin or silicone rubber and containing therein a heat source such as a halogen lamp are pressed together with a suitable pressure and image fixing is performed by passing toner-transferred recording paper through the nipping portion composed of the two rollers.

Since the heat roller method requires that the toner and the recording paper be rapidly heated to a fixable temperature using only the nipping portion composed of the pair of upper and lower rollers pressed together, if a fixing construction capable of a satisfactory transport speed is to be achieved it has been necessary to make the outer diameter of the heat roller large enough to provide the necessary heat capacity, and to use a considerably high fixing temperature; furthermore, to prevent the resulting high temperature offset, application of a large quantity of separation oil has been indispensable.

With this method, however, it has been difficult to shorten warm-up time or reduce power consumption, and there has also been the problem of image smearing, etc. with the separation oil.

As a technique having the potential of being able to solve the above problem, a belt-type fixing device has recently been proposed in Japanese Unexamined Patent Publication JP-A 6-318001.

This belt-type fixing device will be described below with reference to FIGS. 22 and 23.

The fixing device comprises an endless fixing belt 44 stretched around a heating roller 42 with a heat source 41 contained therein and a fixing roller 43, a pressing roller 45 for pressing the fixing roller 43 from below via the fixing belt 44, and a paper entry guide 46 formed in a substantially straight shape and disposed below and in close proximity to the fixing belt 44 and upstream of a nipping portion composed of the fixing belt 44 (fixing roller 43) and the pressing roller 45. The surface temperature of the fixing belt 44 is detected by a temperature sensing element 47 disposed in contacting relationship with the surface of the fixing belt 44 on the heating roller 42 side of the fixing belt 44, and the heat source 41 is controlled on and off using the sensor signal and a controller mounted in the main body (not shown). The fixing belt 44 is a low heat capacity belt constructed from a thin-film endless metal belt coated with a nonadhesive silicone rubber or the like.

When recording paper with an unfixed toner image formed thereon is transported :into the thus constructed fixing device, the toner and the recording paper are preheated through the fixing belt 44, and the toner begins to melt. Accordingly, temperature can be set low for the nipping portion composed of the fixing belt and the pressing roller; also, since the heat capacity of the fixing belt 44 is small, the fixing belt 44 is rapidly cooled when the recording paper passes the nipping portion, which makes it possible to reduce the temperature of the toner on the recording paper separated from the fixing belt 44 at the exit of the nipping portion, the net effect being that an offset-free good quality image can be obtained without using oil or by using a minute quantity of oil.

FIG. 24 is a diagram showing the temperature of the fixing belt on the heating roller side and the temperature of the paper entry guide as a function of time during warm-up from main body power on in the prior art construction.

In the above fixing device, however, sufficient study has not been made considering the setting environment of the main body and double-sided print mode.

More specifically, since the paper entry guide is disposed below and in close proximity to the fixing belt, the leading edge of the recording paper may become wavy or curled when operating in a high temperature, high humidity environment or when printing on the reverse side of the paper in double-sided print mode, as a result of which the leading edge of the recording paper after image transfer may not be inserted into the narrow space between the paper entry guide and the fixing belt, resulting in a recording paper jam, or a recording paper jam may occur during printing operation, causing the main body to stop its operation with the jammed paper squeezed between the paper entry guide and the fixing belt. If this happens, the user has to remove the jammed paper inside the main body and has difficulty in removing the jammed paper squeezed in the narrow space between the paper entry guide and the fixing belt. This has worsened recoverability from paper jamming.

One way to solve the above problem would be to preset the spacing between the paper entry guide and the fixing belt wider, but this would defeat the purpose of preheating the paper entry guide from the fixing belt (to improve the fixing characteristic by raising the temperature of the unfixed toner on the recording paper utilizing the heat contained in the paper entry guide). Another problem is that, in the case of a large heat capacity recording paper such as a thick paper, it is difficult to obtain a good fixing temperature by preheating from the paper entry guide alone.

SUMMARY OF THE INVENTION

A fixing device of the present invention is devised considering the above-outlined problems and is designed to ensure reliable entry of recording paper between a fixing belt and a paper entry guide by moving the paper entry guide when the recording paper enters between the fixing belt and the paper entry guide.

The invention is intended to solve the above-outlined problems, and an object of the invention is to provide a fixing temperature control method capable of detecting temperatures at two places inside the fixing device using two temperature sensing elements, one at a position contacting the fixing belt on the heating roller side and the other at a position contacting the underside of the paper entry guide.

In a first aspect of the invention, a fixing device comprises: a heating roller for heating recording paper onto which a toner image has been transferred; a fixing roller for fixing the toner image to the recording paper heated by the heating roller; an endless fixing belt stretched around the heating roller and the fixing roller; a pressing roller for pressing the recording paper by sandwiching the same against the fixing roller via the fixing belt; and a paper entry guide disposed below the fixing belt in close proximity thereto on an upstream side of a nipping portion composed of the fixing roller and the pressing roller, in a recording paper transport direction, wherein the paper entry guide is mounted in a movable fashion, and is provided with paper entry guide moving means for moving the paper entry guide to a position separated from the fixing belt when the recording paper enters. Accordingly, even when the recording paper has a wavy or curled leading edge, the recording paper can be easily fed onto the paper entry guide since the paper entry guide is moved away from the fixing belt to increase the gap between the paper entry guide and the fixing belt when the recording paper enters. This ensures reliable entry of the recording paper without causing a jam if the leading edge of the recording paper is wavy or curled.

In a second aspect of the invention, the fixing device includes a recording paper detection sensor disposed in a transport path upstream of the paper entry guide, for detecting the recording paper, and paper entry guide moving means for moving the paper entry guide, away from the fixing belt when the recording paper detection sensor detects the recording paper, and back to an initial position of the paper entry guide in close proximity to the fixing belt when a predetermined time has elapsed after the detection of the recording paper. Accordingly, when the recording paper is not present on the paper entry guide, the paper entry guide is moved closer to the fixing belt to reduce the gap between them and thereby preheat the paper entry guide from the fixing belt, and when the recording paper approaches the upstream side of the paper entry guide, the gap between the fixing belt and the paper entry guide is increased to facilitate the entry of the recording paper; when the leading edge of the recording paper is drawn into the space between the fixing belt and the paper entry guide, the gap between the fixing belt and the paper entry guide is again reduced, thereby ensuring reliable transfer of heat from the fixing belt to the recording paper and the unfixed toner on the recording paper before the recording paper is fed into the nipping portion. In this way, the toner image can be fixed reliably even on large heat capacity recording paper such as thick paper.

In a third aspect of the invention a fixing device comprises: a heating roller for heating recording paper onto which a toner image has been transferred; a fixing roller for fixing the toner image to the recording paper heated by the heating roller; an endless fixing belt stretched around the heating roller and the fixing roller; a pressing roller for pressing the recording paper by sandwiching the same against the fixing roller via the fixing belt; and a paper entry guide disposed below the fixing belt in close proximity thereto on the upstream side of a nipping portion composed of the fixing roller and the pressing roller in a recording paper transport direction, wherein the paper entry guide is mounted in a movable fashion, and is provided with paper entry guide moving means for holding the paper entry guide in contact with the fixing belt when the fixing belt is under a stopped condition, and for moving the paper entry guide to a position separated from the fixing belt when the recording paper enters. Accordingly, when the fixing belt is stopped, the paper entry guide is brought into contact with the fixing belt to increase the amount of preheating of the paper entry guide from the fixing belt, ensuring reliable fixing of the toner image even when the recording paper is large heat capacity paper such as thick paper.

In a fourth aspect of the invention, the fixing device is constructed so as to separate the paper entry guide from the fixing belt when the recording paper is jammed. Accordingly the jammed recording paper can be easily removed.

A fifth aspect of the invention is a fixing temperature control method for a belt type fixing device, which comprises: a heating roller for heating recording paper onto which a toner image has been transferred;

a fixing roller for fixing the toner image to the recording paper heated by the heating roller;

an endless fixing belt stretched around the heating roller and the fixing roller;

a pressing roller for pressing the recording paper by sandwiching the same against the fixing roller via the fixing belt; and a paper entry guide disposed below and in close proximity to the fixing belt and on the upstream side, as viewed along a transport direction of the recording paper of a nipping portion composed of the fixing roller and the pressing roller, wherein two temperature sensing elements are arranged at a position contacting the fixing belt on the heating roller side and at a position contacting an underside of the paper entry guide, respectively, so as to detect temperatures at two positions inside the fixing device. Accordingly not only the temperature of the fixing belt but the temperature of the paper entry guide, which changes according to environmental changes and various paper transport conditions, can also be detected, and using data of the thus detected temperatures, effective control of a heater lamp can be achieved.

In a sixth aspect of the invention, the fixing temperature control method comprises the step of:

starting a temperature control of a heater lamp when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, completing warm-up;

otherwise continuing the heating until the predetermined temperature is reached to complete warm up, wherein an ON-OFF control of the heater lamp is performed according to the temperature detected by the sensing element disposed on the heating roller side. Accordingly, even if the temperature of the paper entry guide changes due to environmental changes, etc. during warm-up from main body power on, the temperature is always at or above a predetermined level at the end of the warm-up.

That is, since the paper entry guide can thus retain the amount of heat enough to effectively preheat the reverse side of the recording paper passing through the fixing device, the problem of fixing failure due to insufficient preheating of the recording paper can be prevented.

In a seventh aspect of the invention, the fixing temperature control method comprises the steps of:

constantly monitoring a temperature of the paper entry guide by the temperature sensing element disposed on the underside of the paper entry guide, under a waiting state of a printer main body; and in the case where the temperature drops below a predetermined temperature, starting a temperature control of a heater lamp when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, completing warm-up;

otherwise continuing the heating until the predetermined temperature is reached to complete warm up, wherein an ON-OFF control of the heater lamp is performed according to the temperature detected by the sensing element disposed on the heating roller side. Accordingly, when the main body is placed in a waiting state in a low temperature environment, or when it is attempted to start a printing operation after the main body has been placed in a waiting state for a long time, if the temperature of the paper guide is lower than the predetermined temperature, print ready state is temporarily disabled, and the temperature control of the sixth aspect of the invention is performed, after which the mode is returned to the print ready state; in this way, in the print ready state, the temperature of the paper entry guide is always maintained at or above a predetermined level, and since the paper entry guide can always retain the amount of heat enough to effectively preheat the reverse side of the recording paper, effective preheating can be applied to the reverse side of the recording paper. This serves to prevent the problem of fixing failure due to insufficient preheating.

In an eighth aspect of the invention, the fixing temperature control method comprises the steps of:

when the main body is operating in a multi-printing mode, constantly monitoring a temperature of the paper entry guide by the temperature sensing element disposed on the underside of the paper entry guide; and in the case where the temperature drops below a predetermined temperature, suspending the printing operation and starting a temperature control of a heater lamp when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, completing warm-up;

otherwise continuing the heating until the predetermined temperature is reached to complete warm up, wherein an ON-OFF control of the heater lamp is performed according to the temperature detected by the sensing element disposed on the heating roller side. Accordingly, if there occurs an excessive drop in the temperature of the paper entry guide due to a large volume of multi-printing, the multi-printing operation is temporarily suspended, and the temperature control of the sixth aspect of the invention is performed, after which the multi-printing operation is resumed. In this way, the temperature of the paper entry guide is always maintained at or above the predetermined level during printing, and since the paper entry guide can always retain the amount of heat enough to effectively preheat the reverse side of the recording paper, effective preheating can be applied to the reverse side of the recording paper. This serves to prevent the problem of fixing failure due to the temperature drop of the paper entry guide that can occur during multi-printing.

In a ninth aspect of the invention, a temperature control during jam recovery comprises the step of:

starting a temperature control of a heater lamp while holding the fixing belt in the stopped condition, the temperature control including:

after an elapse of a predetermined time, detecting the temperature of the paper entry guide by the temperature sensing element disposed on the underside of the paper entry guide;

when the detected temperature reaches a predetermined temperature, and when, at that time, the temperature detected by the temperature sensing element disposed on the heating roller side is no less than a predetermined temperature, completing the recovery;

otherwise continuing heating until the predetermined temperature is reached to complete recovery, wherein ON-OFF control of the heater lamp is performed according to the temperature detected by the sensing element disposed on the heating roller side. Accordingly, in cases where the temperature of the paper entry guide is relatively high and the amount of heat is retained that can effectively preheat the reverse side of the recording paper, for example, when the temperature inside the machine is relatively high or when the am recovery is completed in a short time, the problem of fixing failure does not occur if the temperature control of the sixth or seventh aspect of the invention is not performed. Furthermore, the control of this claim can shorten the jam recovery time because the fixing belt is not rotated during the jam recovery.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
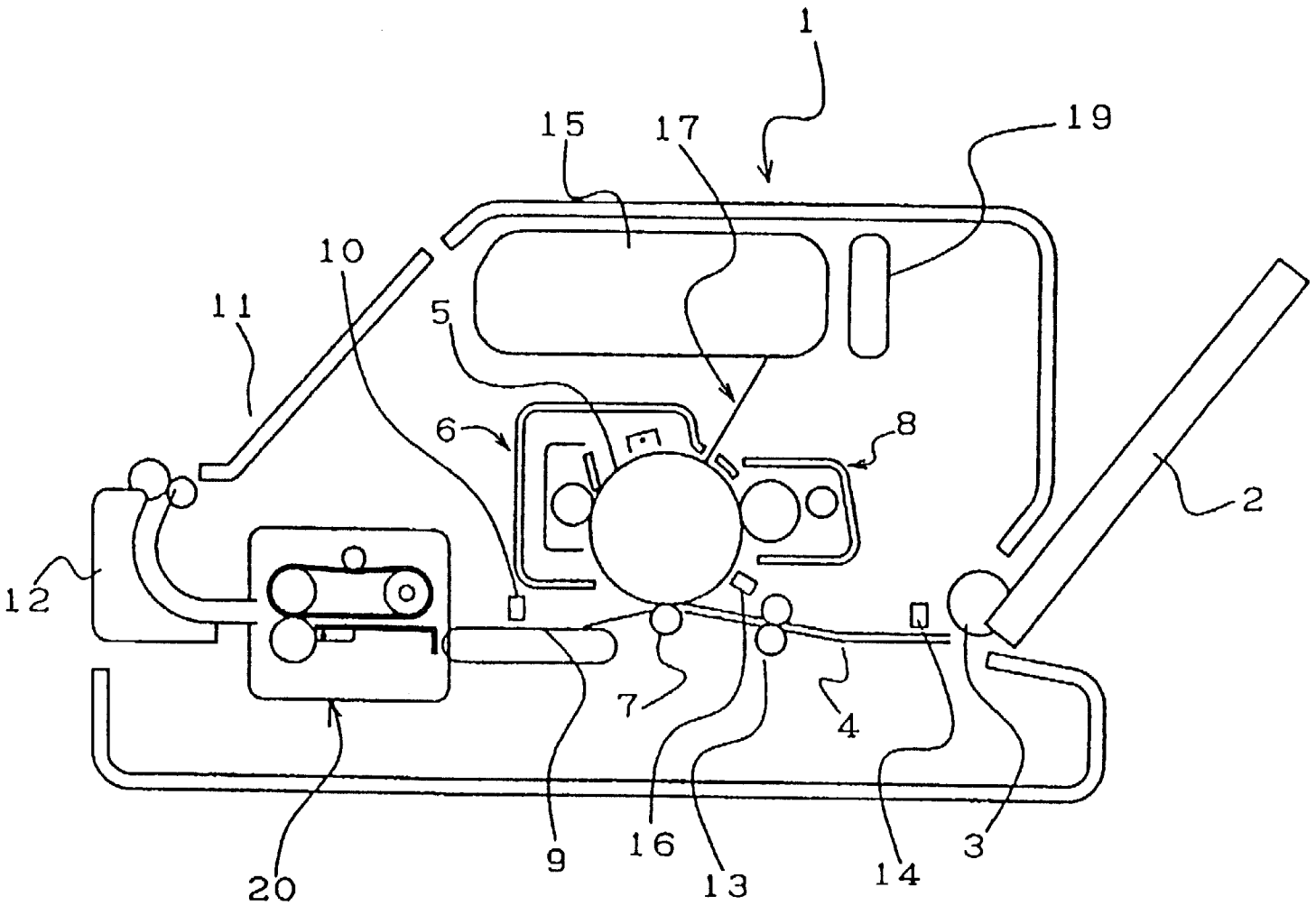
FIG. 1 is a cross-sectional view showing a printer using a fixing device of the present invention.

Now referring to the drawings, preferred embodiments of the invention are described below.

The construction of a printer using a fixing device according to a first embodiment of the present invention will be described with reference to FIG. 1.

A main body 1 of the printer of the present invention is provided at one side thereof with a paper feed tray 2 for feeding a plurality of recording paper sheets. At the lower end of the paper feed tray 2 is disposed a paper feed roller 3 for feeding the recording paper sequentially into the printer for image formation. Further, a recording paper transport path 4, where a PS sensor 14 for detecting the leading edge of the recording paper is disposed, is provided extending substantially in a horizontal direction on the downstream side of the paper transport direction of the paper feed roller 3, and a drum cartridge 6 having a photoconductor drum 5 and a transfer roller 7 are disposed on the downstream side of the recording paper transport path 4.

Disposed further downstream of the transfer roller 7 is a fixing device 20 for fixing the toner image formed on the recording paper, and a U turn guide 12 is provided which ejects the image-formed recording paper onto a paper exit tray 11 on the front cover of the main body 1.

An optical unit 15 for illuminating the photoconductor drum 5 is mounted on the right-hand side of the drum cartridge 6.

Light 17 emitted from the optical unit 15 is directed to the precharged surface of the photoconductor drum 5, thereby exposing the photoconductor drum 5 and forming an electrostatic latent image on the surface of the photoconductor drum 5.

Toner supplied from a developing device 8 is applied and made to adhere to the photoconductor drum 5 to develop the electrostatic latent image and, with the rotation of the photoconductor drum 5, the resulting toner image is moved toward a section where the photoconductor drum 5 is contacting the transfer roller 7.

In the meantime, recording paper is fed from the paper feed tray 2 by means of the paper feed roller 3, and the recording paper is transported along the recording paper transport path 4, while activating the PS sensor 14 on the way, toward a pair of stationary PS rollers 13 consisting of an upper and a lower roller.

After that, the PS rollers 13 begin to rotate in synchronism with the light emitting timing of the optical unit 15 controlled by a controller 19 by reference to an ON signal from the PS sensor 14, and the recording paper is transported to a transfer region where the photoconductor drum 5 is contacting the transfer roller 7. When the recording paper passes through the transfer region, the toner image formed on the surface of the photoconductor drum 5 is transferred onto the recording paper because of the potential difference between the charge of the toner image and the charge on the surface of the recording paper.

Next, the recording paper is guided into a recording paper transport path 9 provided with a recording paper detecting suction sensor 10, and then enters the fixing device 20.

The fixing device 20 comprises an endless fixing belt 21 stretched around a heating roller 23 with a heat source 26 contained therein and a fixing roller 24, a pressing roller 25 for pressing the fixing roller 24 from below via the fixing belt 21, and a paper entry guide 22 formed in a substantially straight shape and disposed below and in close proximity to the fixing belt 21 and upstream of a nipping portion 27 composed of the fixing belt 21 and the pressing roller 25. The fixing belt 21 is a low heat capacity belt constructed from a thin-film endless metal belt coated with a nonadhesive silicone rubber or the like.

When recording paper with an unfixed toner image formed thereon is transported into the thus constructed fixing device 20, the toner and the recording paper are preheated through the fixing belt 21, and the toner begins to melt. Accordingly, temperature can be set low for the nipping portion 27 composed of the fixing belt 21 and the pressing roller 25; also, since the heat capacity of the fixing belt 21 is small, the fixing belt 21 is rapidly cooled when the recording paper passes the nipping portion 27, which makes it possible to reduce the temperature of the toner on the recording paper separated from the fixing belt 21 at the exit of the nipping portion 27, the net effect being that an offset-free good quality image can be obtained without using oil or by using a minute quantity of oil.

Then, the recording paper fed out of the fixing device 20 is guided upward of the main body 1 along the U turn guide 12 and ejected onto the paper exit tray 11.

Figure 2:
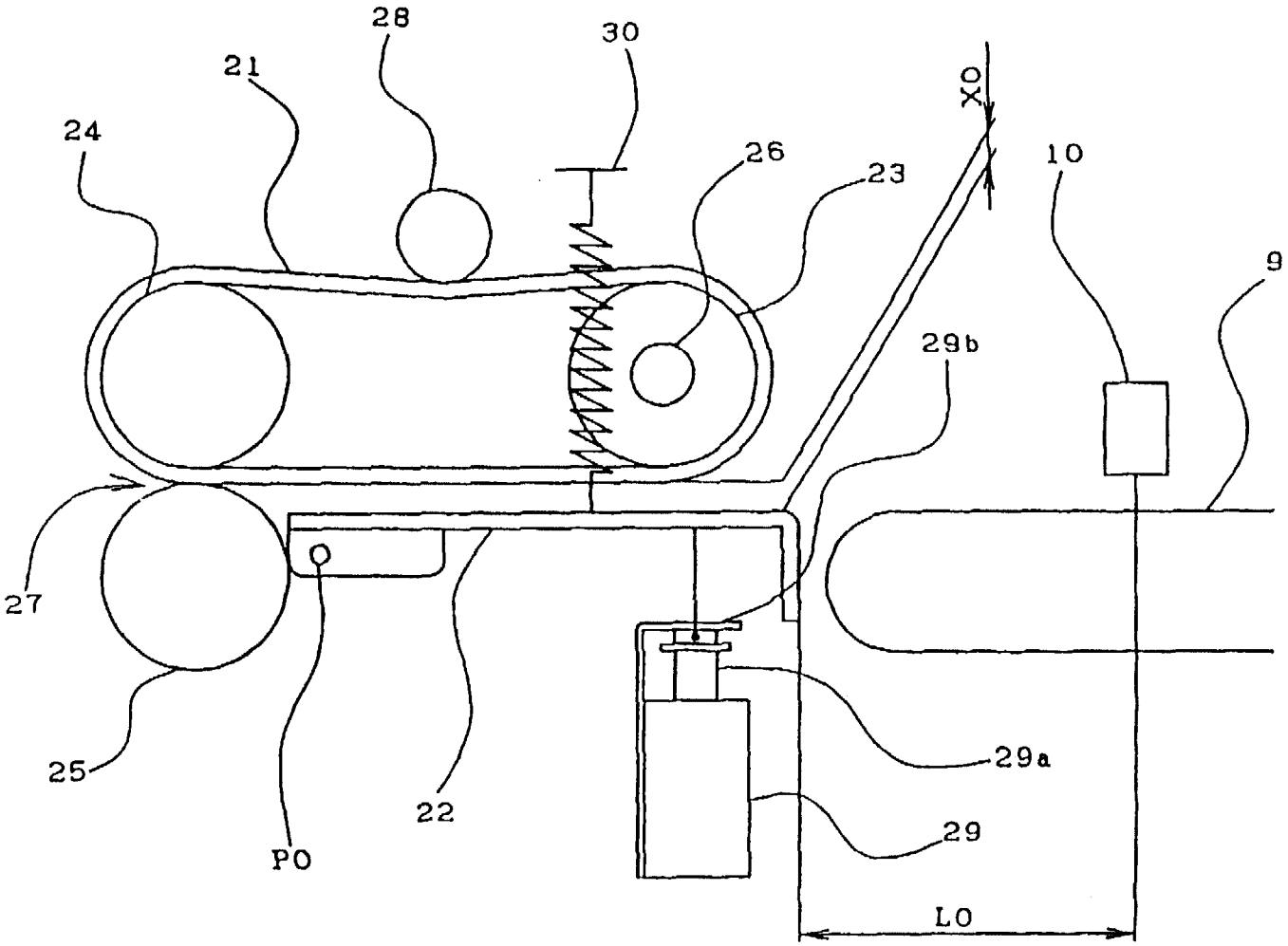
FIG. 2 is a cross-sectional view showing a first embodiment of the fixing device of the present invention.
Figure 3:
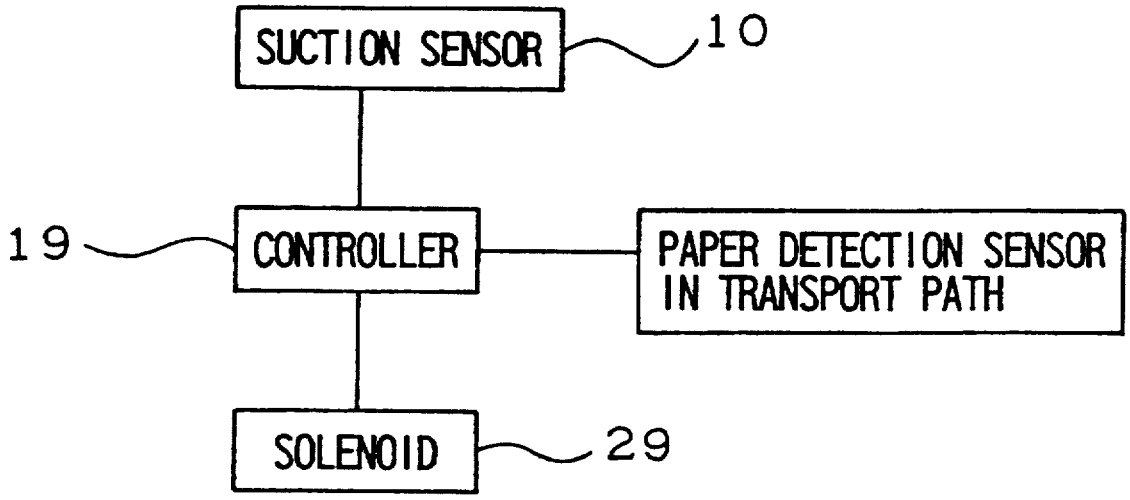
FIG. 3 is a control block diagram for controlling an operation of a paper entry guide in the fixing device of FIG. 2.

FIG. 2 is a cross-sectional view showing the construction of the fixing device 20 according to the present invention, and FIG. 3 is a control block diagram for controlling the rotating operation of the paper entry guide.

The paper entry guide 22 of the fixing device 20 is pivotably supported by a fulcrum $P_0$ so that the paper entry guide 22 can be rotated about the fulcrum $P_0$. Further, a solenoid 29 is provided at the upstream side of the paper entry guide 22, and a return spring 30 is disposed above the paper entry guide 22. Normally, when the solenoid 29 is in the OFF state, the upper edge of a plunger 29*a* is pressed against a stopper 29*b* by the upwardly urging force of the return spring 30, and the paper entry guide 22 is held in a stopped position maintaining a spacing $X_0$ with respect to the fixing belt 21. When the solenoid 29 is in the ON state, its pulling force overcomes the spring force of the return spring 30 and pulls the plunger 29*a* down to its lowermost position, as a result of which the paper entry guide 22 is rotated clockwise about the fulcrum $P_0$ and held in a stopped position maintaining a spacing $X_1$ with respect to the fixing belt 21.

As described above, the paper entry guide 22 can be moved in rotating fashion by the ON-OFF control of the solenoid 29.

Next, the rotation timing of the paper entry guide 22 during printing will be described below.

Figure 4:
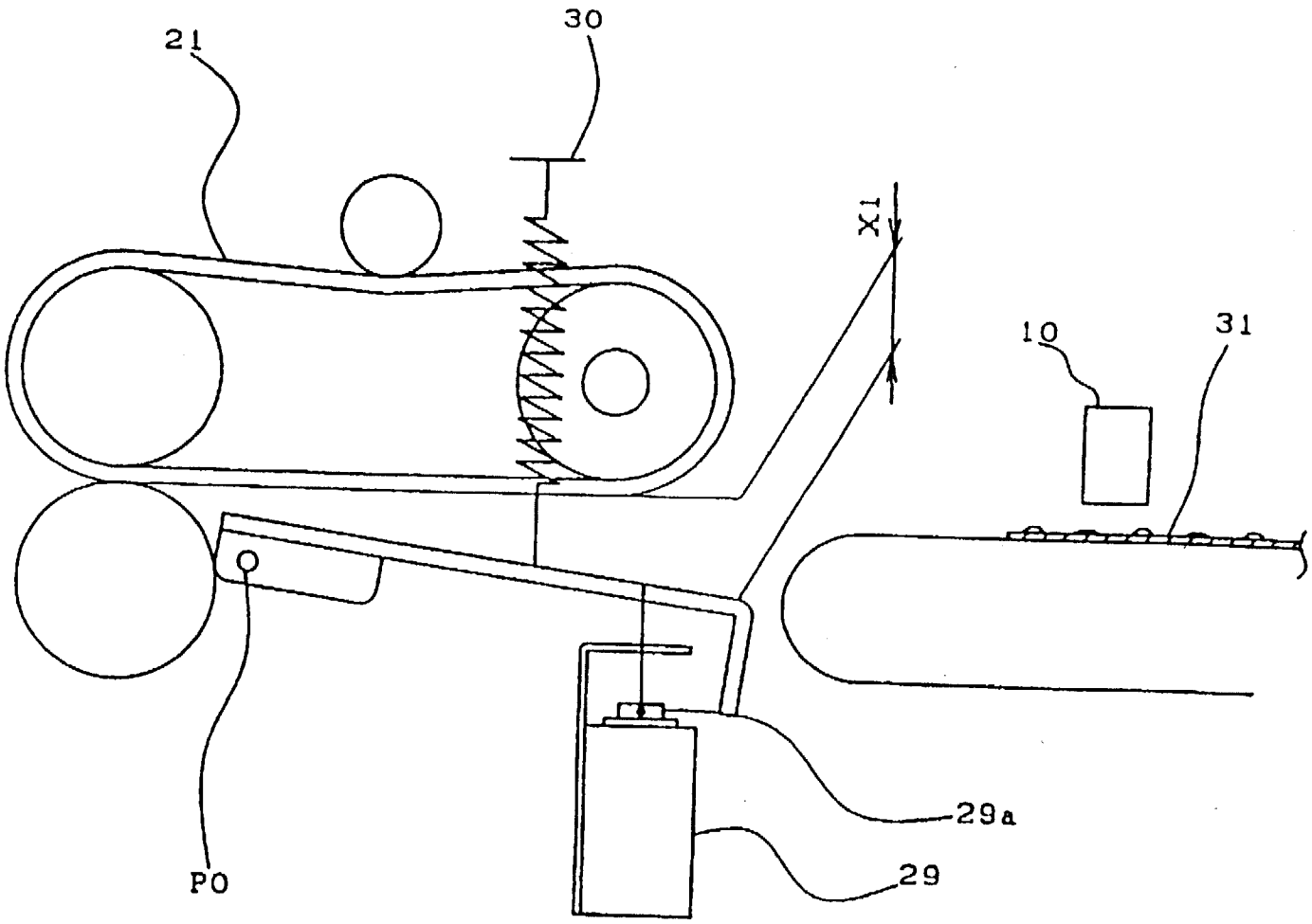
FIG. 4 is a cross-sectional view showing a condition of the fixing device of the first embodiment during paper entry.

When the recording paper 31 with the toner made to adhere to its upper surface in the transfer step is transported on the recording paper transport path 9, the leading edge of the paper activates the recording paper detecting suction sensor 10. The ON signal of the suction sensor 10 is sent to the controller 19 which, after to seconds, issues an ON signal to the solenoid 29; and with the actuation of the solenoid 29, the paper entry guide 22 is rotated clockwise about the fulcrum $P_0$, and is held in a stop position maintaining the spacing $X_1$ with respect to the fixing belt 21, allowing the leading edge of the recording paper 31 to be drawn into the widened opening between the fixing belt 21 and the paper entry guide 22 (see FIG. 4).

Figure 5:
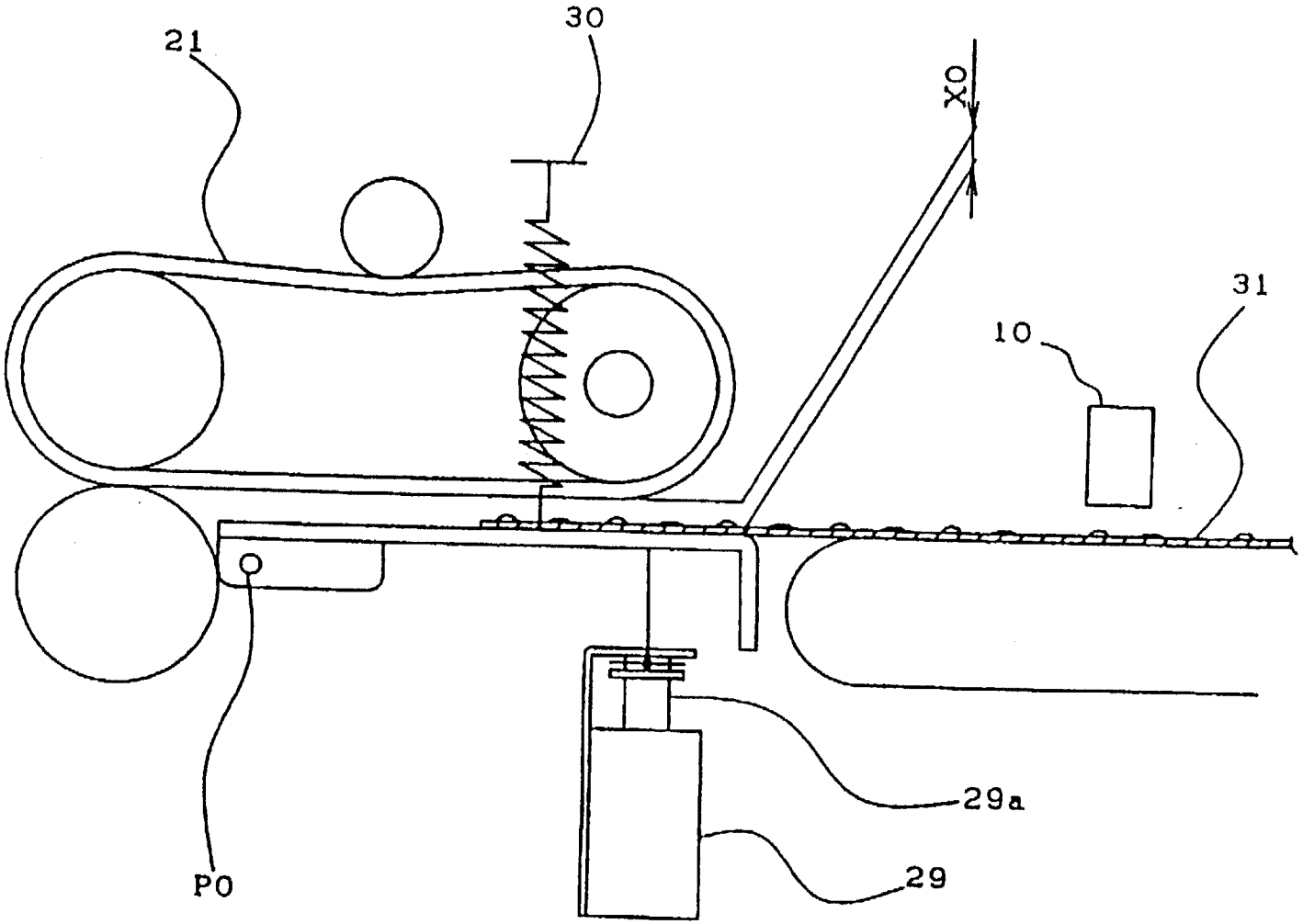
FIG. 5 is a cross-sectional view showing a condition of the fixing device of the first embodiment after paper entry.

Next, after $t_1$ seconds, an OFF signal is sent from the controller 19 to the solenoid 29; and with the deactuation of the solenoid 29 and the upwardly urging force of the return spring 30, the paper entry guide 22 is turned upward, so that the spacing with respect to the fixing belt 21 is now returned to $X_0$ (see FIG. 5). After that, the recording paper 31 is preheated by the heat of the fixing belt 21 and transported to the nipping portion 27, completing the fixing of the unfixed toner image to the recording paper 31.

Next, the operation of the paper entry guide 22 will be described below when a recording paper jam occurs during printing.

Figure 6:
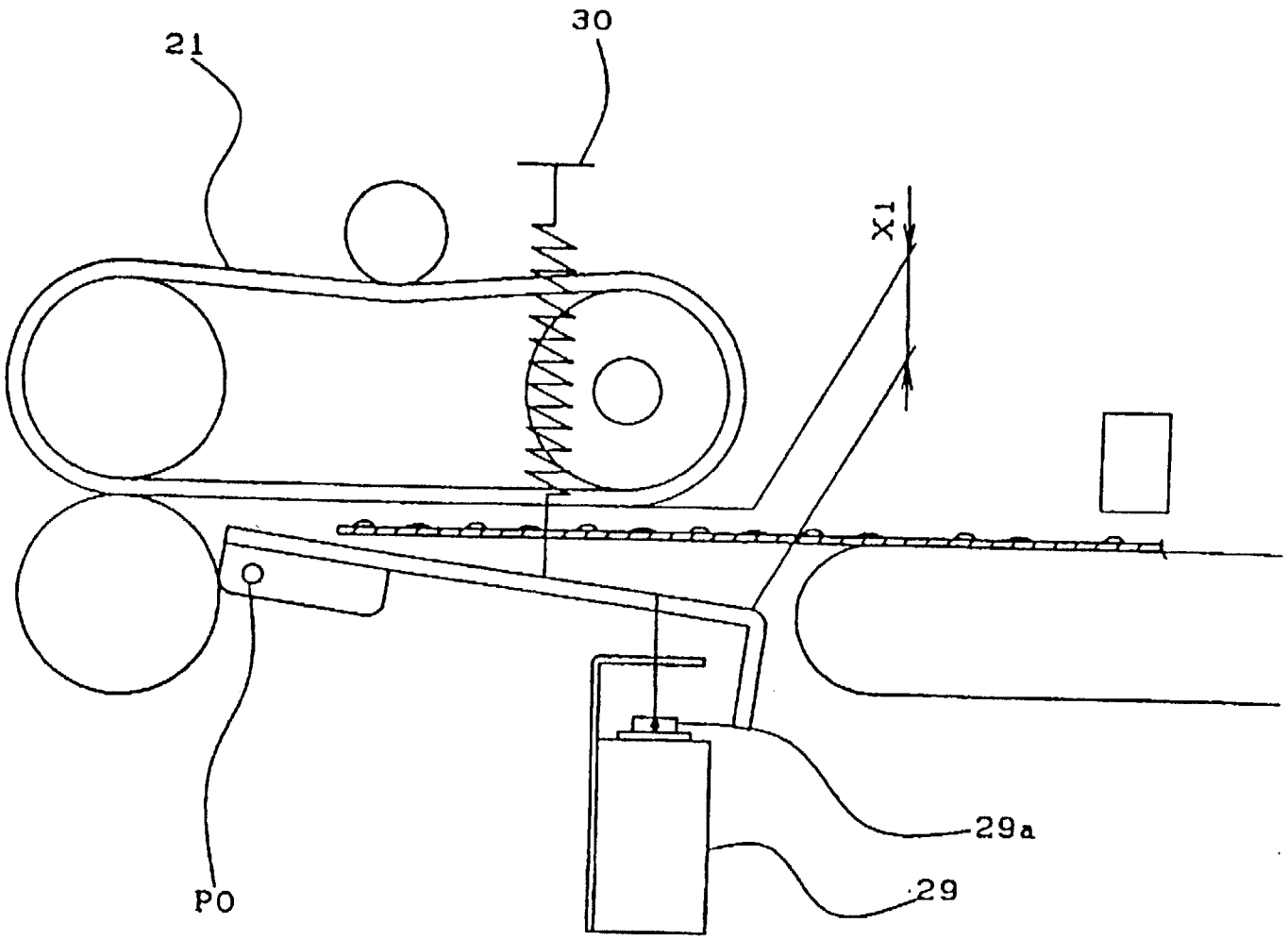
FIG. 6 is a cross-sectional view showing a condition of the fixing device of the first embodiment when a jam has occurred.

Besides the suction sensor 10, a plurality of recording paper detection sensors (not shown) are arranged along the transport path of the recording paper 31 in the printer machine. When a recording paper jam occurs at some position along the transport path, the sensor at or near that position sends a recording paper jam signal to the controller 19. The printer main body 1 then suspends the printing operation, and in synchronism with that timing, the controller 19 sends an ON signal to the solenoid 29 which is thus actuated; as a result, the paper entry guide 22 is rotated clockwise about the fulcrum $P_0$, increasing the spacing with respect to the fixing belt 21 to $X_1$ (see FIG. 6).

Figure 7:
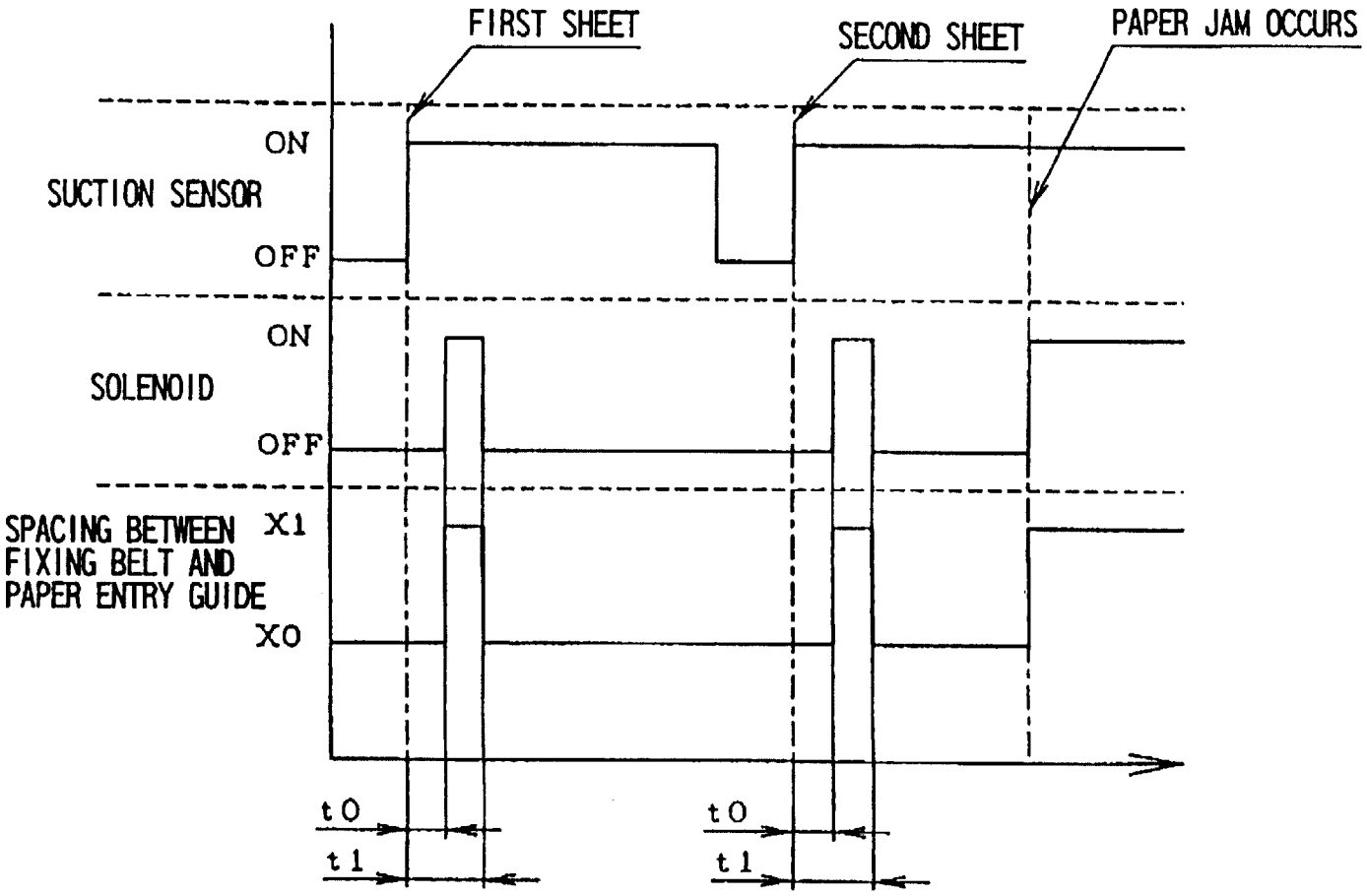
FIG. 7 is a timing chart showing the operation timings of various parts in the first embodiment of the present invention.

FIG. 7 is a timing chart showing the ON-OFF signal of the suction sensor 10 and the ON-OFF signal of the solenoid 29 in relation to the spacing between the fixing belt 21 and the paper entry guide 22. Here, control is performed so that the following relations (1) and (2) hold between $t_0$, $t_1$, $L_0$, and V.

$$t_0<L_0/V \quad (1)$$

$$t_1>L_0/V \quad (2)$$

$t_0$: Time elapsing from the moment the suction sensor 10 is activated by the leading edge of the recording paper 31 to the moment the solenoid 29 is actuated $t_1$: Time elapsing from the moment the suction sensor 10 is activated by the leading edge of the recording paper 31 to the moment the solenoid 29 is deactuated $L_0$: Distance from the suction sensor 10 to the upstream edge of the paper entry guide 22

V: Transport speed of the recording paper 31

When the fixing device 20 is constructed and controlled as described above, if the leading edge of the recording paper becomes wavy or curled due to environmental changes or when printing on the reverse side of the paper in double-sided print mode, printing on the recording paper can be done without causing the leading edge of the recording paper to be caught and jammed in the opening between the fixing belt 21 and the paper entry guide 22; furthermore, if a recording paper jam should occur during printing, the paper jammed in the fixing device 20 can be removed easily from the printer machine since the spacing between the fixing belt 21 and the paper entry guide 22 is increased.

Next, a second embodiment of the fixing device of the present invention will be described with reference to drawings.

Figure 8:
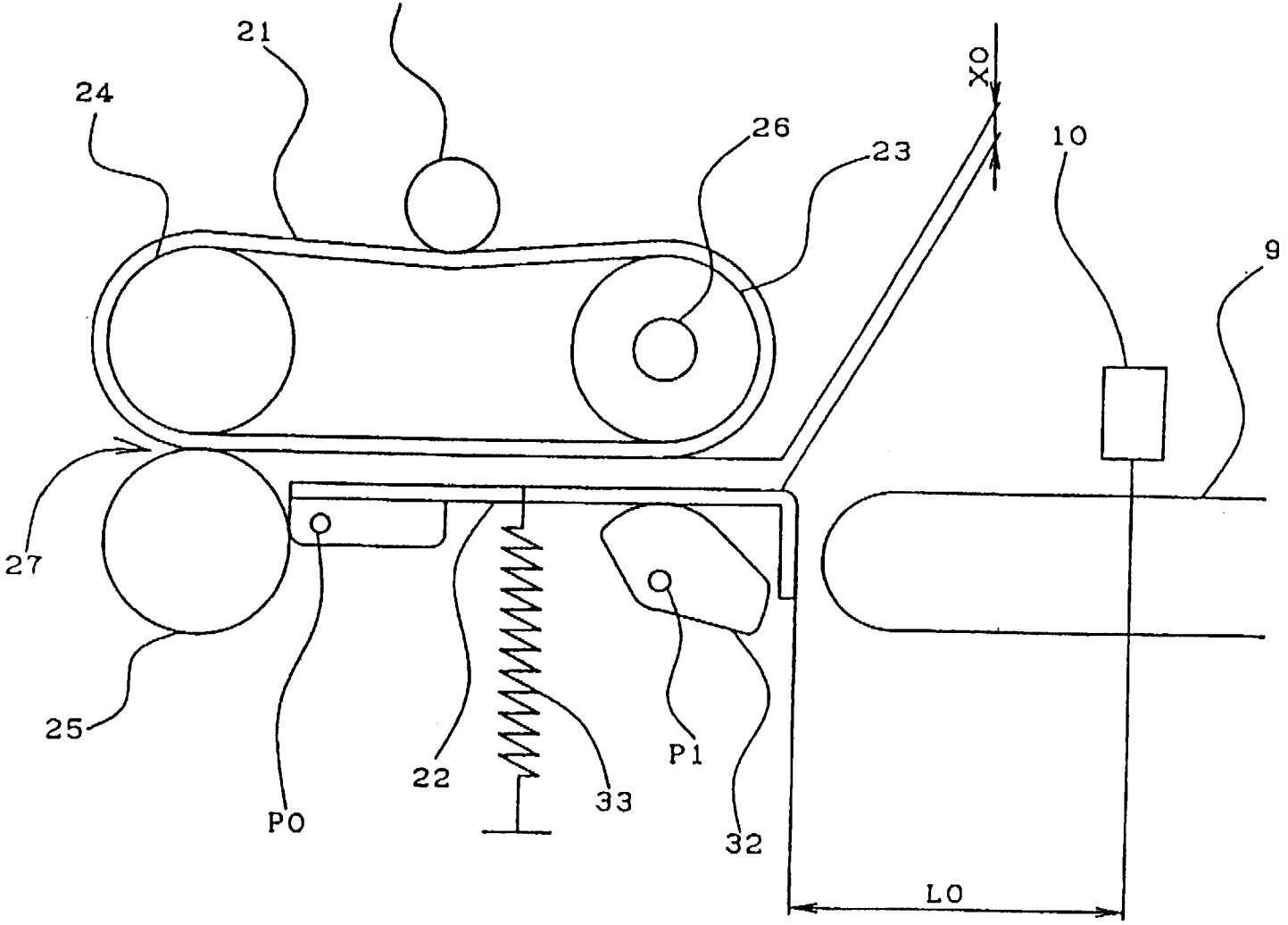
FIG. 8 is a cross-sectional view showing a second embodiment of the fixing device of the present invention.
Figure 9:
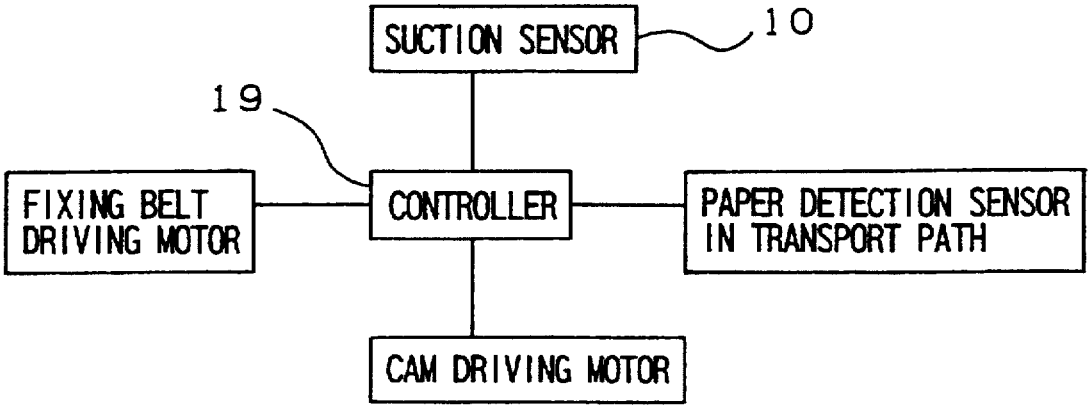
FIG. 9 is a control block diagram for controlling an operation of a paper entry guide in the fixing device of FIG. 8.

FIG. 8 is a cross-sectional view showing the construction of the fixing device according to the second embodiment of the present invention, and FIG. 9 is a diagram showing a control block for controlling the rotating operation of the paper entry guide.

In the second embodiment, the rotating operation of the paper entry guide 22 is fundamentally the same as that in the first embodiment, except that the number of positions where the paper entry guide 22 is held stopped is increased by one compared with the first embodiment. More specifically, in the first embodiment, the paper entry guide 22 is held stopped maintaining a spacing of either $X_0$ or $X_1$ with respect to the fixing belt 21; in addition to these conditions, in the second embodiment there is a condition in which the paper entry guide 22 is held in contact with the fixing belt 21.

In the second embodiment, a cam 32, a cam spring 33, and a cam driving motor (not shown) for rotating the cam 32 constitute the rotating means for the paper entry guide 22. The paper entry guide 22 is constantly pulled downward by the cam spring 33, and is moved to a designated position by being turned about $P_0$ with the rotation angle of the cam 32 which rotates about $P_1$. The rotating operation of the fixing belt 21 is controlled by a fixing belt driving motor not shown.

Operation will now be described below when the printer main body enters the print mode from the standby state.

Figure 10:
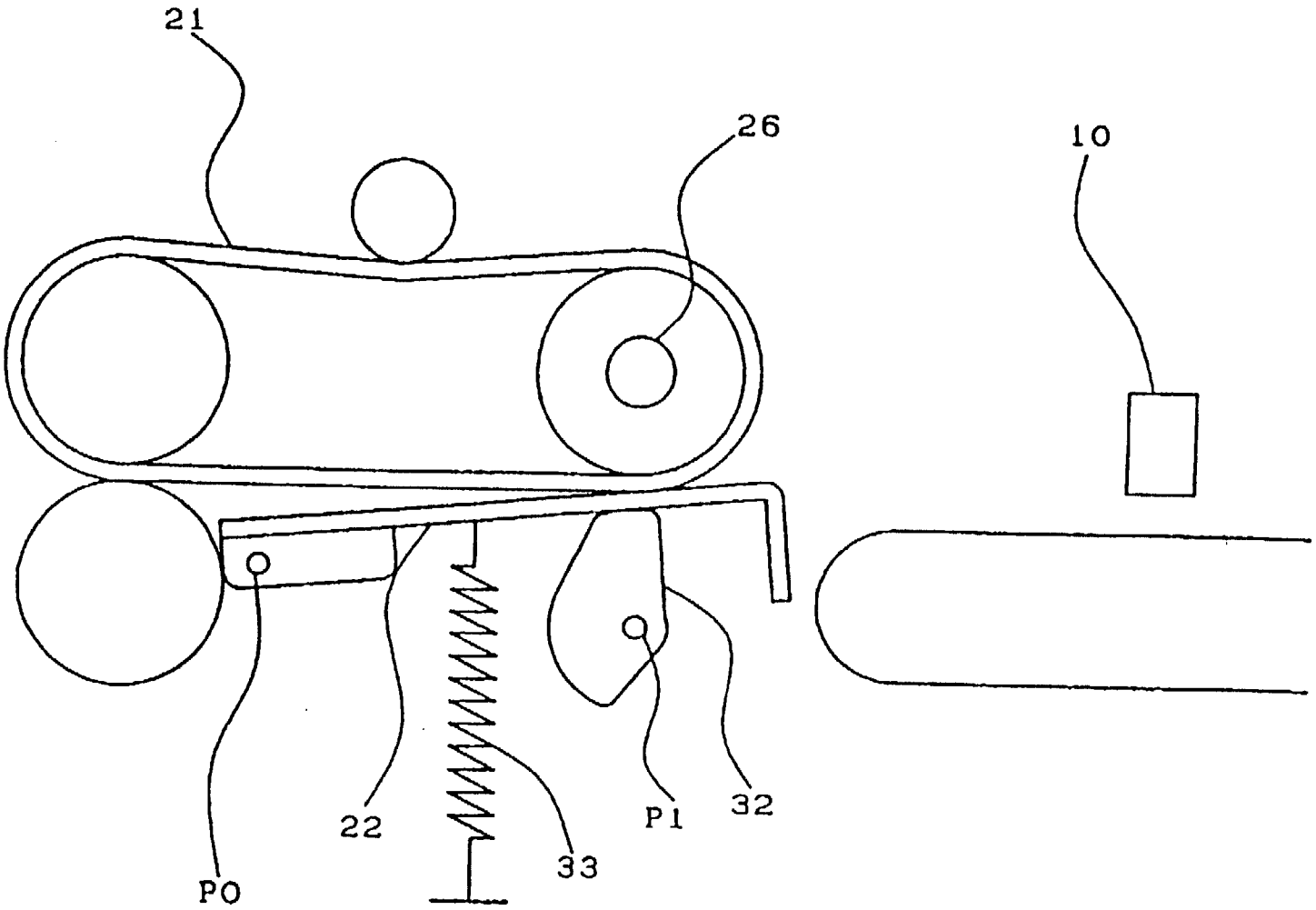
FIG. 10 is a cross-sectional view showing a condition of the fixing device of the second embodiment in a standby state.

In the description below, the rotation angle of the cam 32 shown in FIG. 10 is denoted by $\alpha$, the rotation angle of the cam 32 shown in FIGS. 11 and 13 by $\beta$, and the rotation angle of the cam 32 shown in FIGS. 12 and 14 by $\gamma$. That is, control is performed so that the cam 32 stops at one of the three positions corresponding to $\alpha$, $\beta$, and $\gamma$.

When the printer main body is in the standby state, the fixing belt 21 is stopped, and a stop signal is sent from the fixing belt driving motor (not shown) to the controller 19. In response to the stop signal, the cam 32 is rotated to the position corresponding to the rotation angle $\alpha$ by means of the controller 19 and the cam driving motor not shown, as a result of which the paper entry guide 22 is held stopped with its upper surface at the upstream side held contacting the surface of the fixing belt 21 (FIG. 10).

Figure 11:
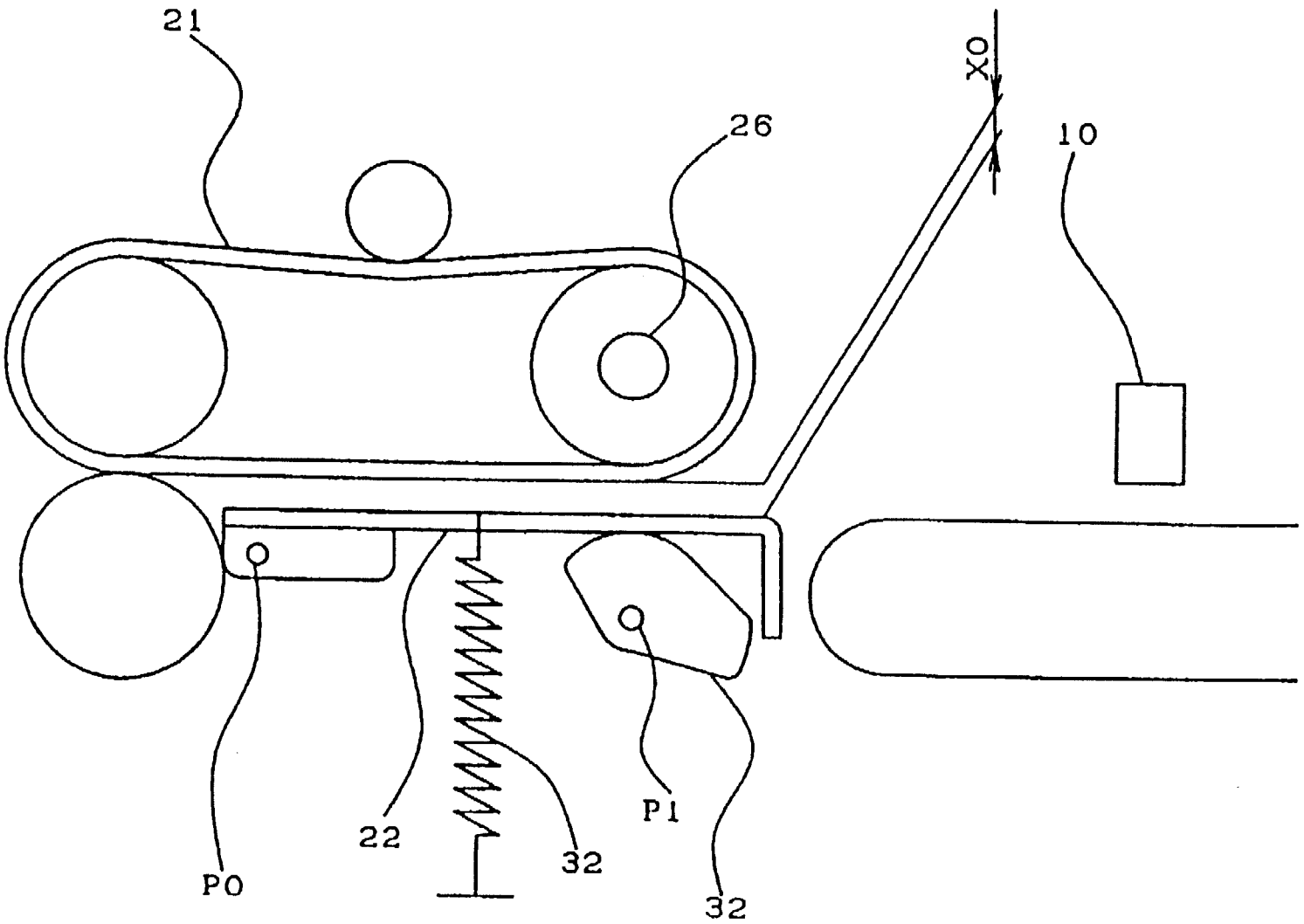
FIG. 11 is a cross-sectional view showing a condition of the fixing device of the second embodiment before paper entry.

Next, when a print command is input to the printer from an external apparatus such as a personal computer, the controller 19 and the cam driving motor not shown rotate the cam 32 in the clockwise direction until reaching the rotation angle $\beta$, where the paper entry guide 22 is held stopped maintaining the spacing $X_0$ with respect to the fixing belt 21 (FIG. 11).

Figure 12:
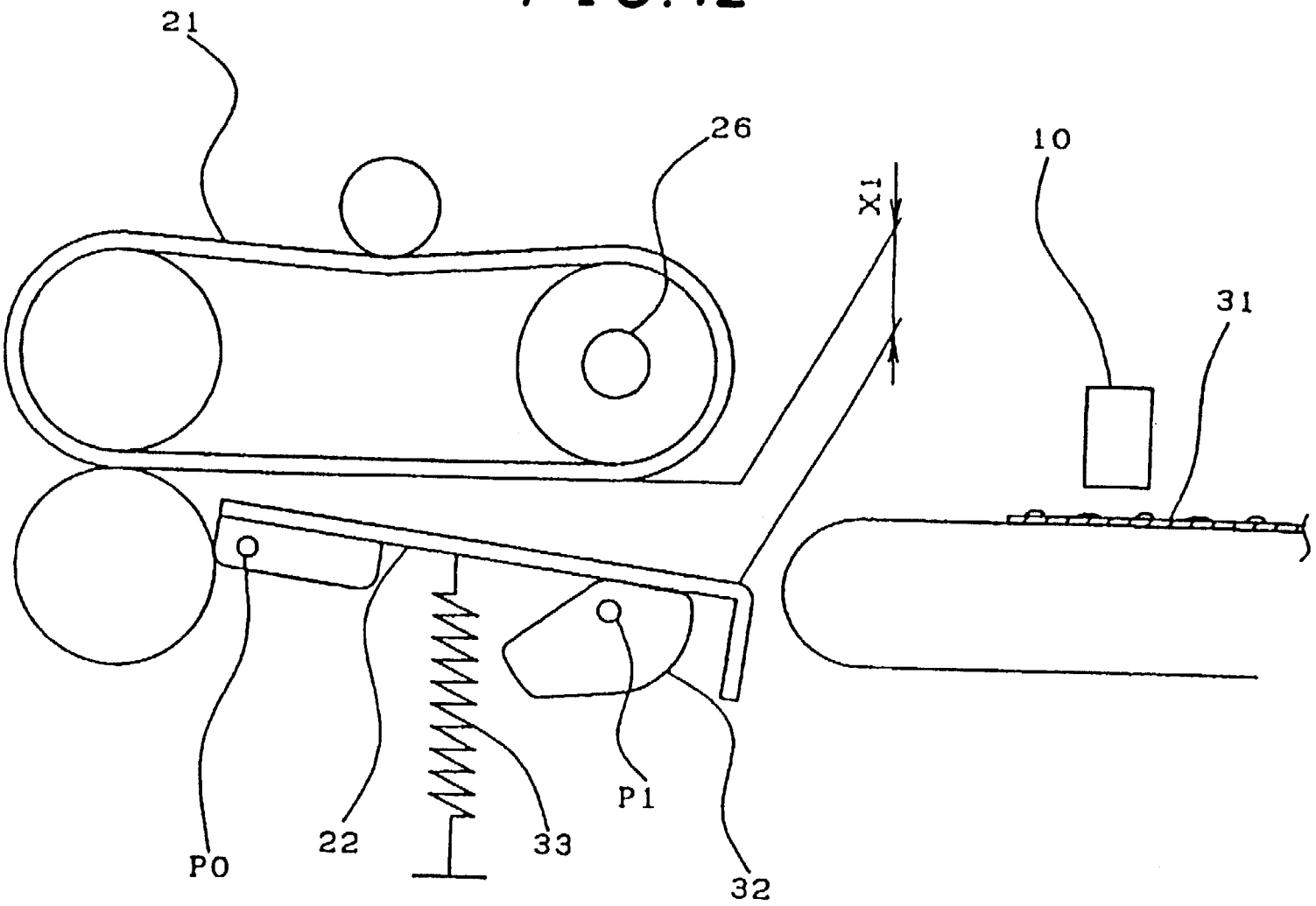
FIG. 12 is a cross-sectional view showing a condition of the fixing device of the second embodiment during paper entry.

When the recording paper 31 with the toner made to adhere to its upper surface in the transfer step is transported on the recording paper transport path 9, and the leading edge of the paper activates the recording paper detecting suction sensor 10, the ON signal of the suction sensor 10 is sent to the controller 19, and $t_0$ seconds after that, the cam 32 is rotated in the clockwise direction until reaching the rotation angle $\gamma$ by means of the controller 19 and the cam driving motor not shown, and the paper entry guide 22 is then held stop maintaining the spacing $X_1$ with respect to the fixing belt 21, allowing the leading edge of the recording paper 31 to be drawn into the widened opening between the fixing belt 21 and the paper entry guide 22 (FIG. 12).

Figure 13:
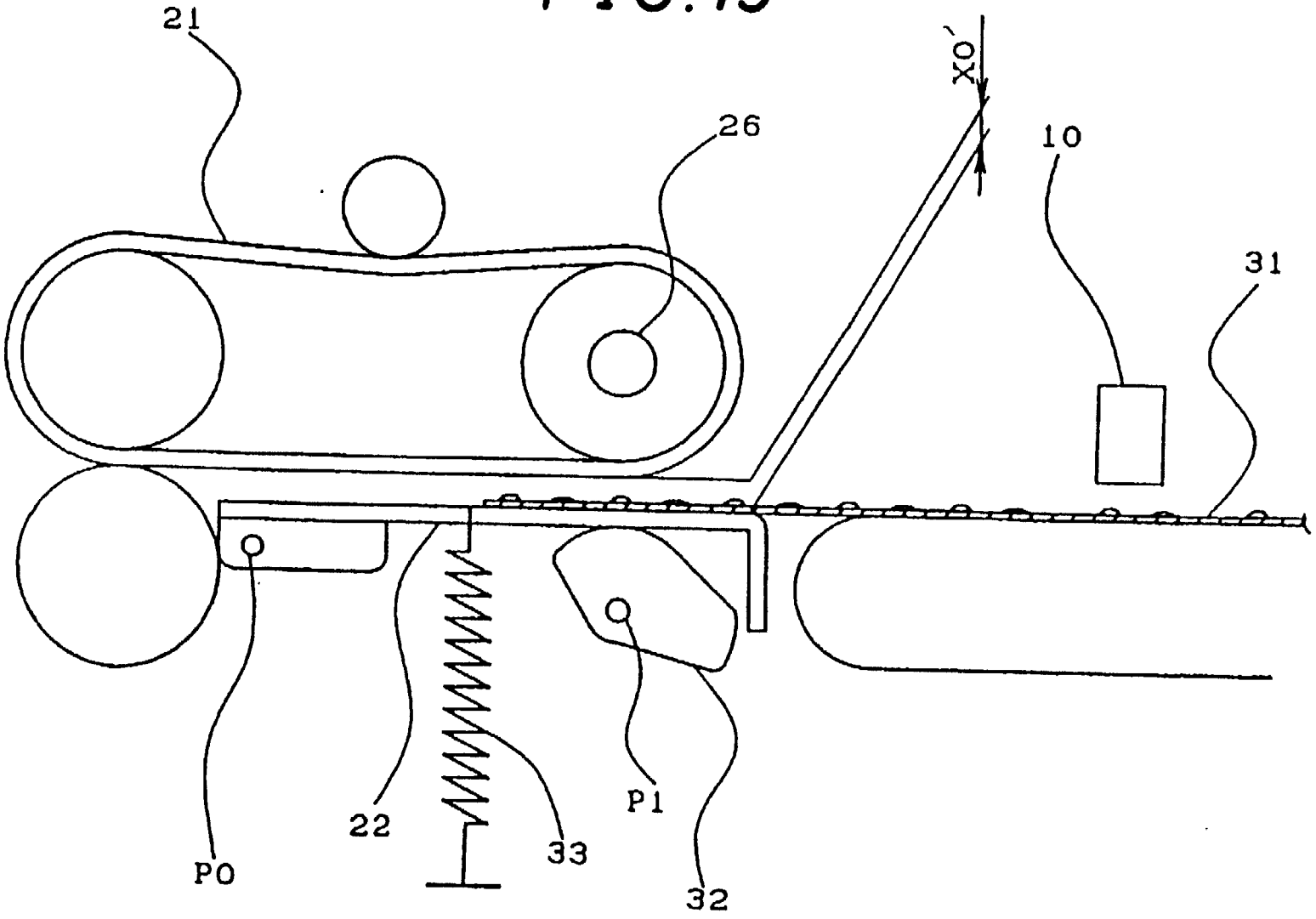
FIG. 13 is a cross-sectional view showing the condition of the fixing device of the second embodiment after paper entry.

When $t_1$ seconds have elapsed after that, the cam 32 is now rotated in the counterclockwise direction until reaching the rotation angle $\beta$, and the paper entry guide 22 is held stopped again maintaining the spacing $X_0$ with respect to the fixing belt 21 (FIG. 13). Then, the recording paper 31 is preheated by the heat from the fixing belt 21 and the paper entry guide 22 and transported to the nipping portion 27, completing the fixing of the unfixed toner image to the recording paper 31.

Next, the operation of the paper entry guide 22 will be described below when a recording paper jam occurs during printing.

Figure 14:
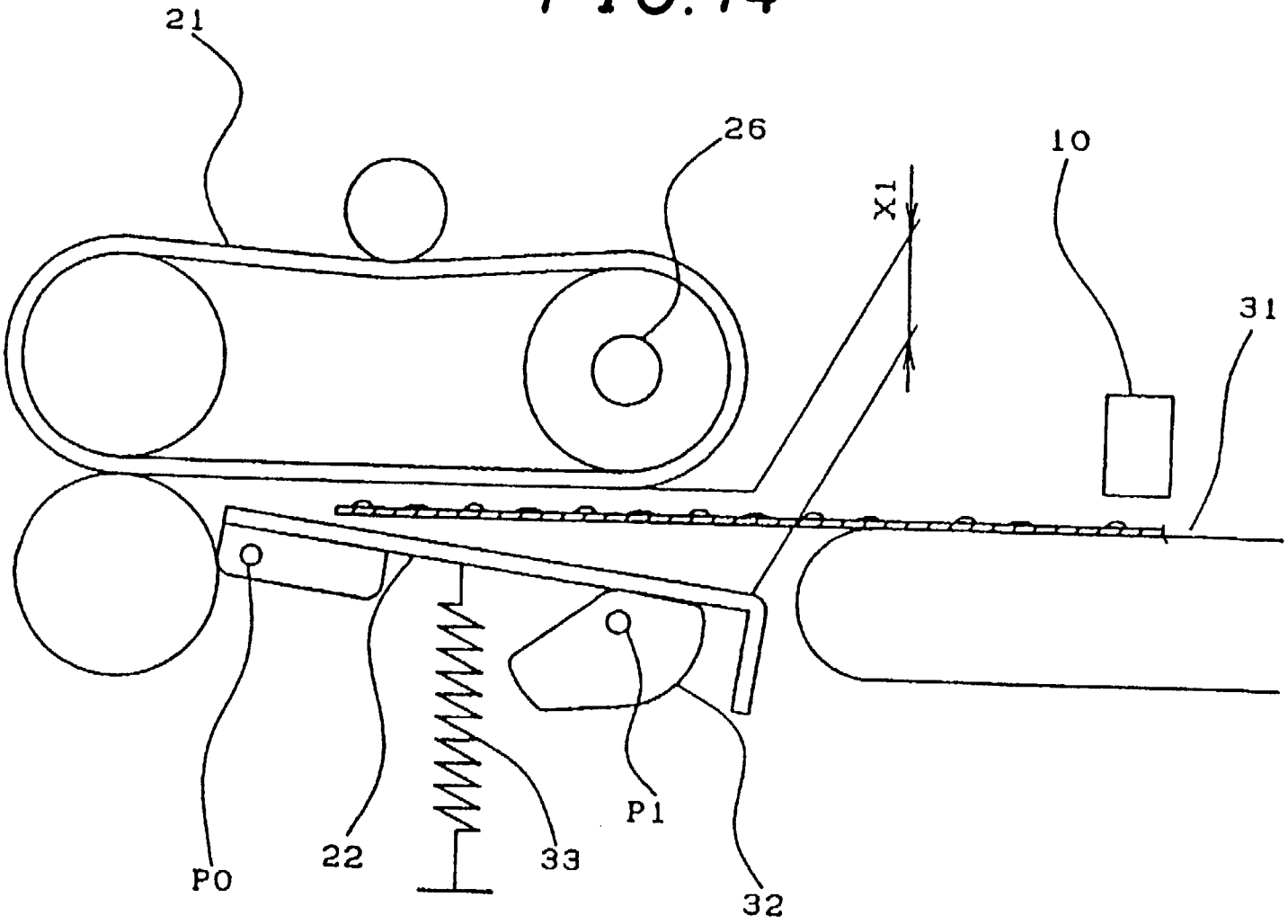
FIG. 14 is a cross-sectional view showing the condition of the fixing device of the second embodiment when a jam has occurred.

The operation in the event of a paper jam is similar to that in the first embodiment; that is, the printer main body suspends its printing operation, and in synchronism with that timing, the controller 19 controls the cam driving motor (not shown) to rotate the cam 32 until reaching the rotation angle $\gamma$, as a result of which the spacing between the paper entry guide 22 and the fixing belt 21 is widened to $X_1$ (FIG. 14). In this case, the fixing belt 21 is stopped; though the condition is the same as in the standby state in that the fixing belt 21 is stopped, it is possible to distinguish the paper jam condition from the standby condition since a jam signal is sent to the controller 19 In the event of a paper jam.

Designations $t_0$ and $t_1$ in the above description and $L_0$ in the accompanying drawing have the same meanings as those explained in the first embodiment, and the relations (1) and (2) also hold between $t_0$, $t_1$, $L_0$, and the transport speed V of the recording paper 31.

Figure 15:
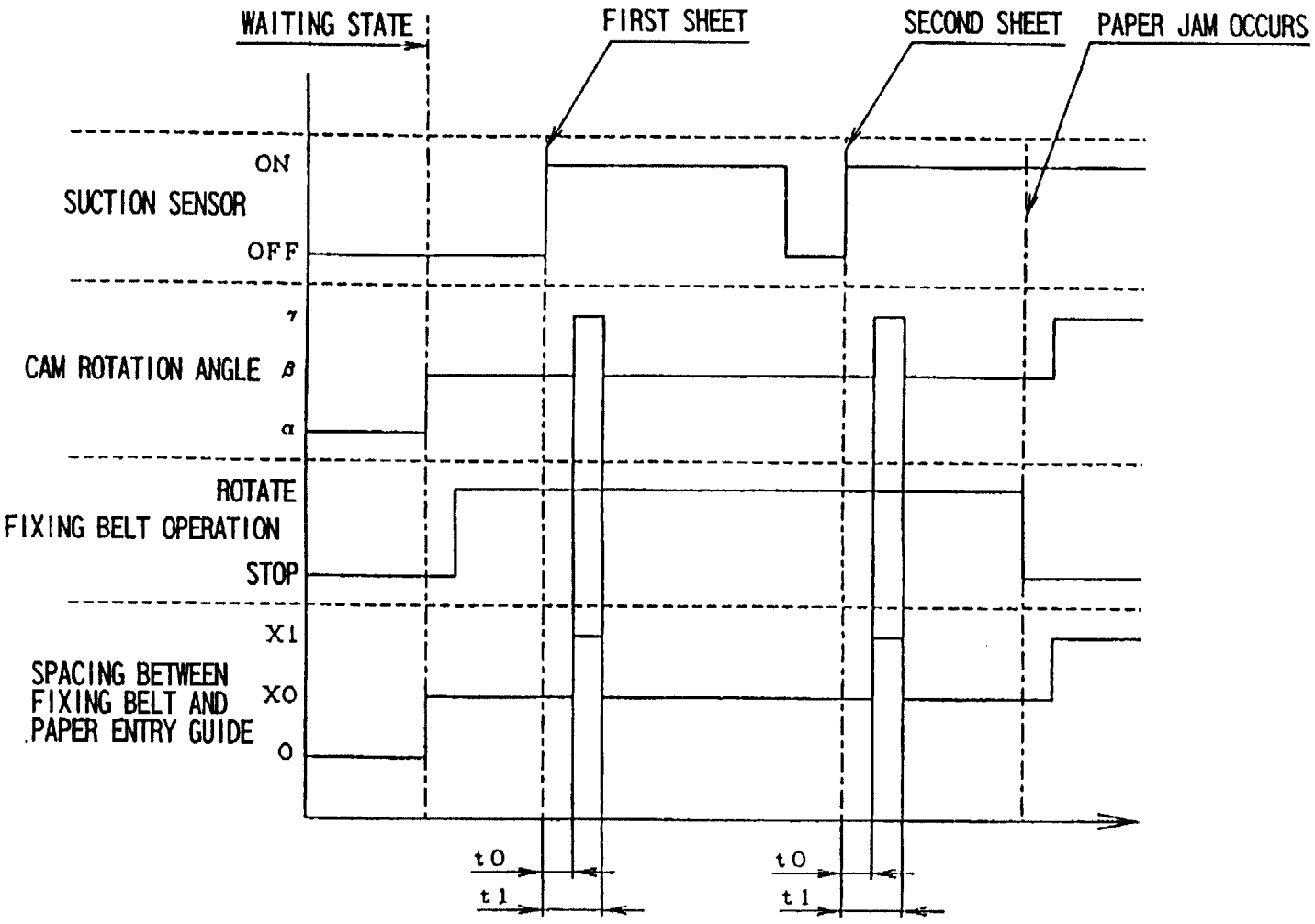
FIG. 15 is a timing chart showing the operation timings of various parts in the second embodiment of the present invention.

FIG. 15 is a timing chart showing the ON-OFF signal of the suction sensor 10 in relation to the rotation angle of the cam 32, the operation of the fixing belt 21, and the spacing between the fixing belt 21 and the paper entry guide 22.

When the fixing device 20 is constructed and controlled as described above, if the leading edge of the recording paper becomes wavy or curled due to environmental changes or when printing on the reverse side of the paper in double-sided print mode, printing on the recording paper can be done without causing the leading edge of the recording paper 31 to be caught and jammed in the opening between the fixing belt 21 and the paper entry guide 22; furthermore, in cases where the paper entry guide 22 is required to provide a larger preheating effect, for example, when the ambient temperature of the printer is low and, therefore, the temperature of the paper entry guide 22 itself is low, or when printing is performed on a large heat capacity recording paper such as a thick paper, greater preheating can be provided by heat conduction from the fixing belt 21 to the paper entry guide 22, and therefore, the thus heated paper entry guide 22 can preheat the reverse side of the recording paper during the subsequent printing process, thus ensuring good fixing strength when printing on a large heat capacity recording paper such as a thick paper. Moreover, if a recording paper jam should occur during printing, the paper jammed in the fixing device 20 can be removed easily from the printer machine since the opening between the fixing belt 21 and the paper entry guide 22 is increased.

In the above embodiments, in the event of a recording paper jam the paper entry guide 22 is moved by the same amount as when the recording paper enters, but the amount of movement at this time may be further increased to make the removal of the jammed paper easier.

Figure 16:
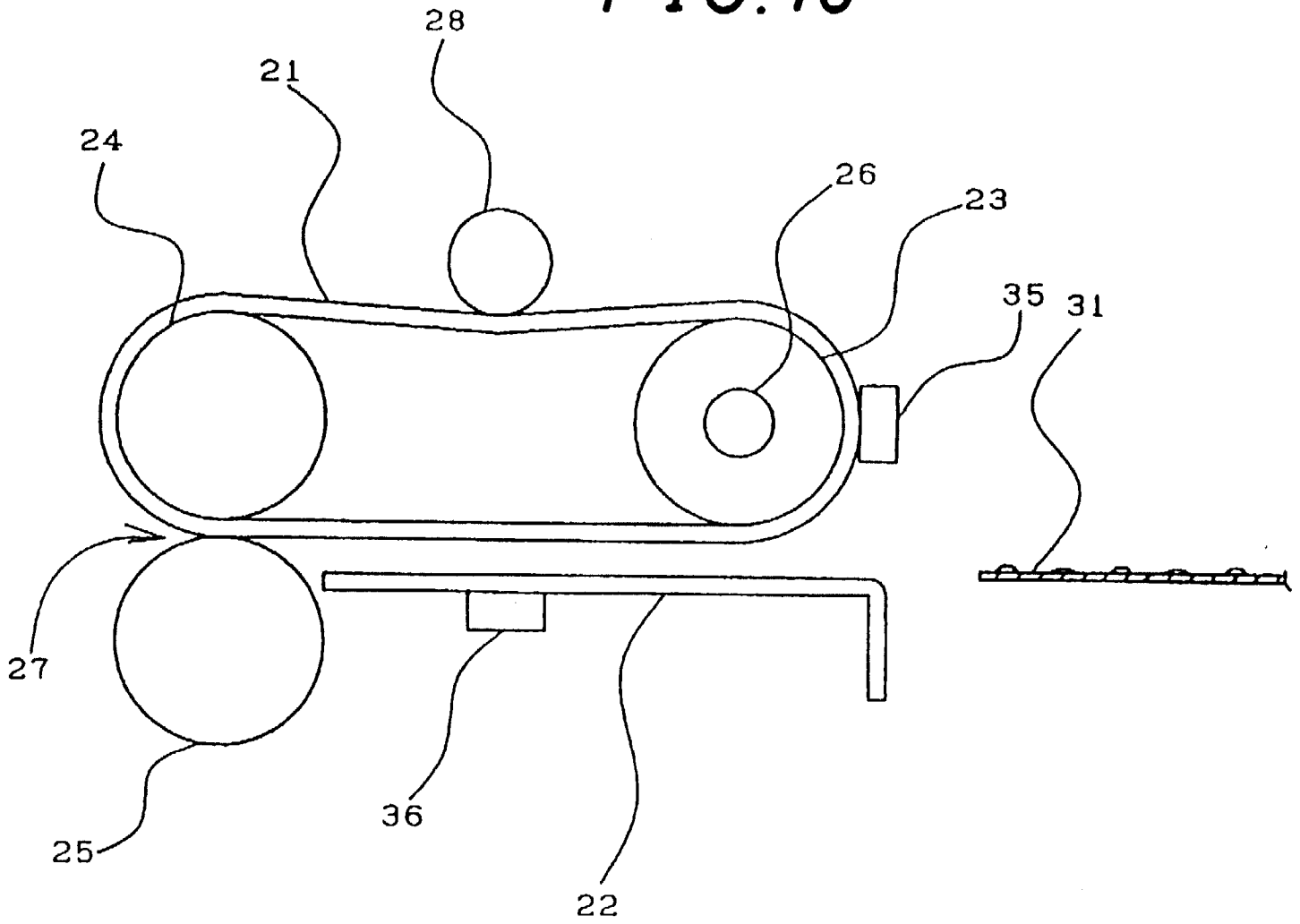
FIG. 16 is a diagram showing a construction of a fixing device corresponding to third to sixth embodiments of the present invention.

FIG. 16 is a diagram showing a construction of the fixing device 20 of the present invention. A third embodiment corresponding to the fifth and sixth aspects of the invention will be described below with reference to FIG. 16.

A temperature sensing element (thermistor) 35 is disposed facing the outer circumference of the heating roller 23 and contacting the surface of the fixing belt 21, and a temperature sensing element (thermistor) 36 is attached approximately at the center of the underside of the paper entry guide 22, so that the temperature of the fixing belt 21 on the heating roller 23 side and the temperature at the center of the underside of the paper entry guide 22 can be detected respectively.

Figure 17:
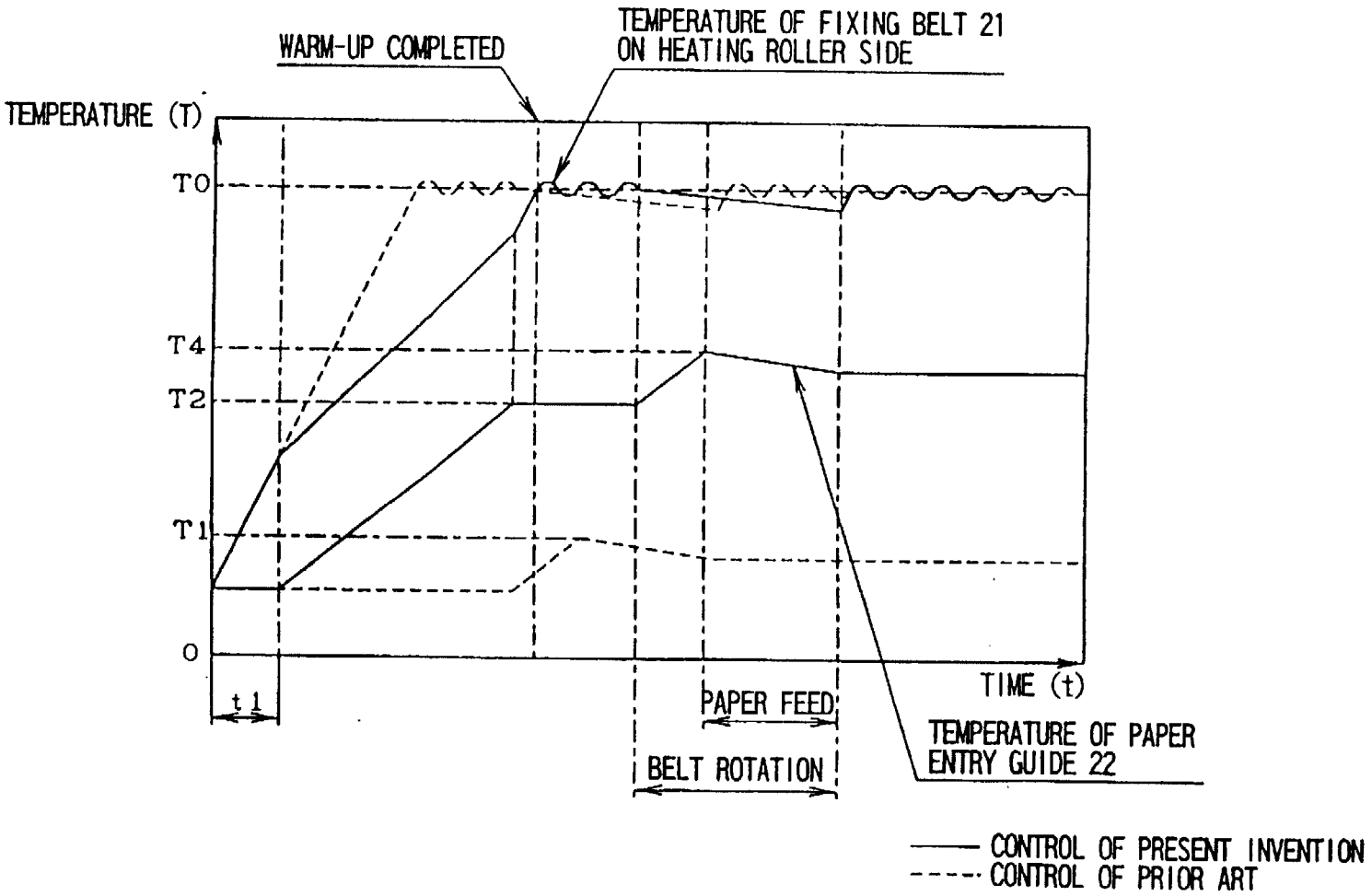
FIG. 17 is a diagram showing the temperature of a fixing belt on the heating roller side and the temperature of a paper entry guide as a function of time during warm-up from main body power on, corresponding to the third embodiment of the present invention.

FIG. 17 shows the temperature of the fixing belt 21 on the heating roller side and the temperature of the paper entry guide 22 as a function of time during warm-up from main body power on.

In the following description, TH1 and TH2 are defined as follows:

TH1: Temperature of the fixing belt 21 on the heating roller 23 side (the temperature detected by the thermistor 35)

TH2: Temperature at the center of the underside of the paper entry guide 22 (the temperature detected by the thermistor 36)

When power is turned on to the main body, the heater lamp 26 is turned on, and TH1 begins to rise from room temperature. At this time, TH2 is still at room temperature. Next, $t_1$ seconds after power on, the driving device not shown begins to rotate the fixing belt 21. As the fixing belt 21 rotates, the rate of rise of TH1 becomes moderate, while on the other hand, TH2 remaining at room temperature up to that time now begins to rise because of the preheating effect from the fixing belt 21. After that, TH2 reaches T2, the temperature of the paper entry guide 22 at which good fixing strength can be obtained. At this time, if the temperature TH1 is lower than T0 which is the control temperature of the heater lamp 26, heating is continued until TH1 reaches T0, and the warm-up is completed when TH1 reaches T0.

If TH1 reaches T0 before TH2 reaches T2, the heater lamp 26 is turned off, but since the fixing belt 21 keeps running, the heat accumulated in the fixing belt 21 is transferred to the paper entry guide 22, and TH1 drops below T0. As a result, the heater lamp 26 is turned on again, and the same control is repeated until TH2 reaches T2, when TH1 is judged again before completing the warm-up.

That is, whether the rotating fixing belt 21 is to be stopped or not is determined by checking whether the condition $TH2 \geqq T2$ is satisfied or not, the ON-OFF control of the heater lamp 26 is performed by comparing TH1 with T0, and the warm-up is terminated when the condition $TH1 \geqq T0$ is satisfied.

In FIG. 17, solid lines represent the temperature of the fixing belt 21 on the heating roller side and the temperature of the paper entry guide 22 according to the present embodiment, and dotted lines show the corresponding temperatures according to the prior art.

As is apparent from FIG. 17, in the present embodiment the temperature of the paper entry guide 22 at the start of printing is T4, which is higher than the temperature T1 of the paper entry guide 22 at the start of printing in the prior art. As a result, even when the temperature of the operating environment is low, or when printing is performed on a large heat capacity paper such as a thick paper, sufficient heat can be transferred to the reverse side of the recording paper from the paper entry guide 22, and therefore, the problem of fixing failure does not occur.

A fourth embodiment corresponding to the seventh aspect of the invention will be described below.

Figure 18:
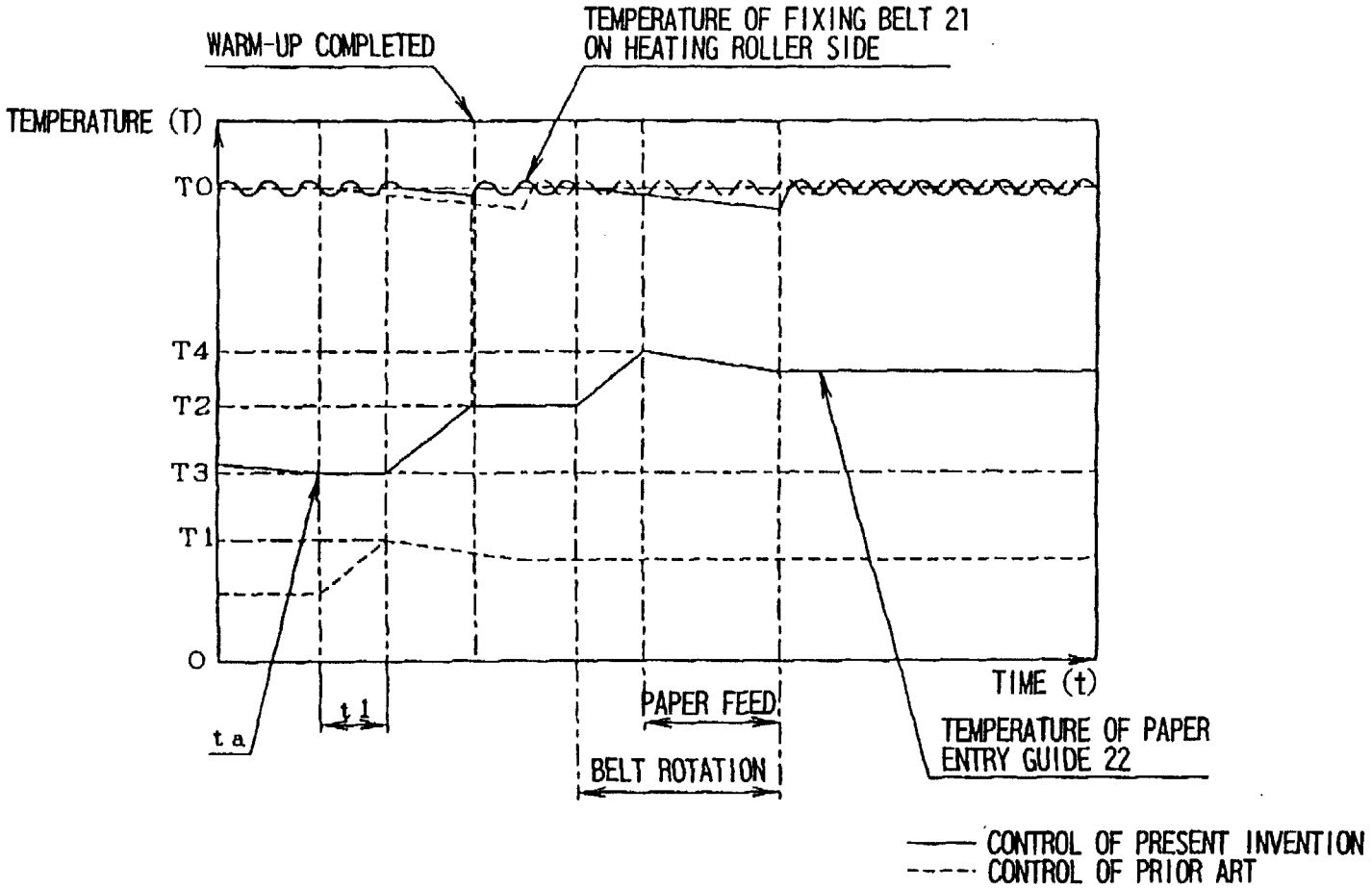
FIG. 18 is a diagram showing the temperature of the fixing belt on the heating roller side and the temperature of the paper entry guide as a function of time during warm-up from waiting state, corresponding to the fourth embodiment of the present invention.

FIG. 18 shows the temperature of the fixing belt 21 on the heating roller side and the temperature of the paper entry guide 22 as a function of time during warm-up from the waiting state.

If the waiting state of the main body continues for a long time, TH2 gradually drops because the fixing belt 21 is stopped for a long time, while on the other hand, TH1 is constantly held around T0 by the ON-OFF control of the heater lamp 26.

In the present embodiment, when TH2 drops below a predetermined temperature T3 (indicated by ta in the Fig.), print ready state is disabled, and warm-up state is entered using the temperature control method of the third embodiment After that, the warm-up is terminated, and the mode returns to the print ready state.

As is apparent from FIG. 18, in the present embodiment also, as in the third embodiment, the temperature of the paper entry guide 22 at the start of printing is T4, which is higher than the temperature T1 of the paper entry guide 22 at the start of printing in the prior art. As a result, if the waiting state of the main body continues for a long time, and the temperature of the paper entry guide 22 drops due to heat dissipation into the air, heating can be performed again to recover the temperature of the paper entry guide 22; in this way, sufficient heat can be transferred to the reverse side of the recording paper, and therefore, the problem of fixing failure does not occur.

A fifth embodiment corresponding to the eighth aspect of the invention will be described below.

Figure 19:
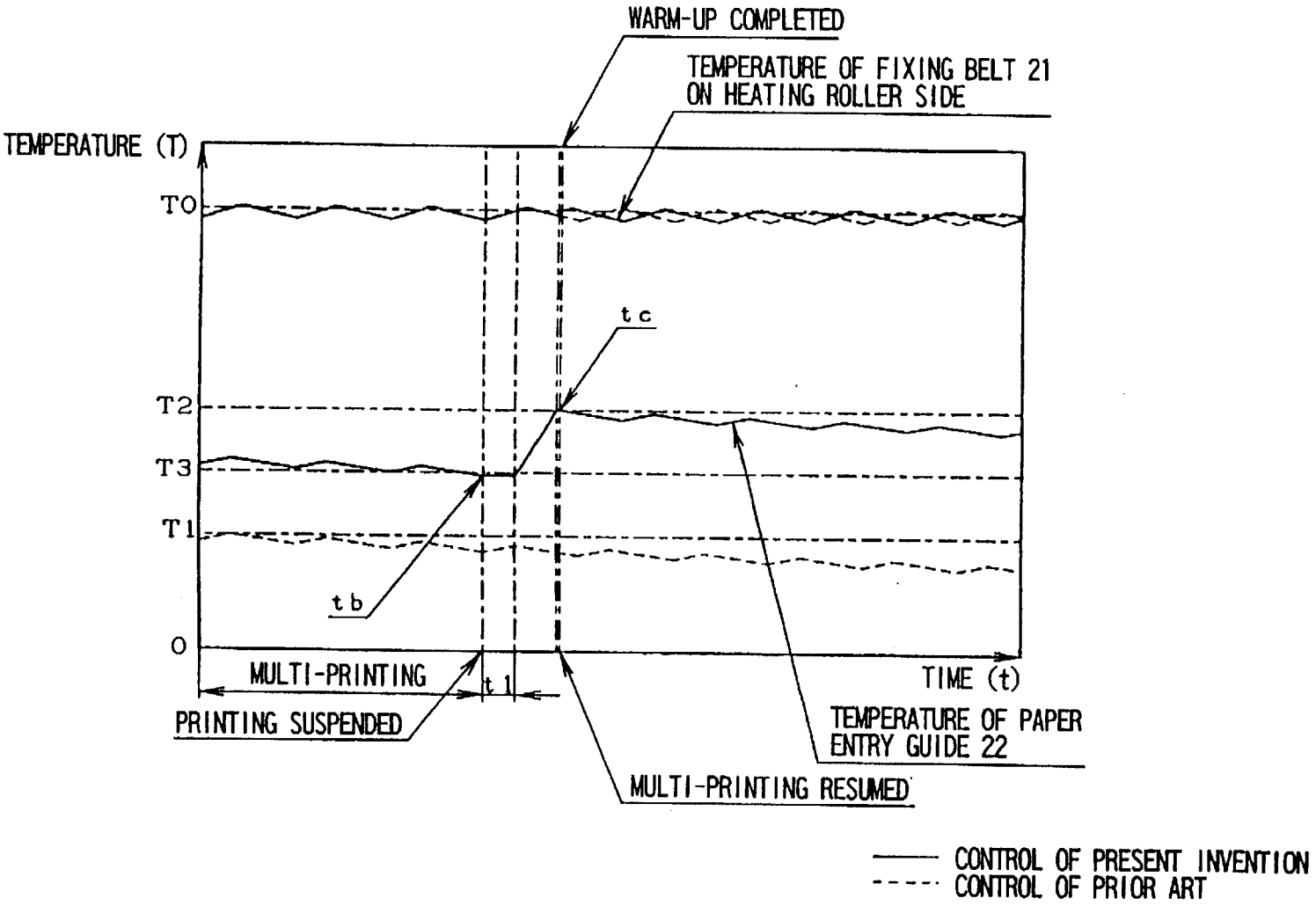
FIG. 19 is a diagram showing the temperature of the fixing belt on the heating roller side and the temperature of the paper entry guide as a function of time during warm-up from multi-printing state, corresponding to the fifth embodiment of the present invention.

FIG. 19 shows the temperature of the fixing belt 21 on the heating roller side and the temperature of the paper entry guide 22 as a function of time during warm-up from multi-printing state.

When the combined amount of the energy consumed within the fixing device 20 and the energy consumed for the recording paper and toner exceeds the amount of the energy supplied from the heater lamp 26 because of a large volume of multi-printing, the temperature of the paper entry guide 22 begins to drop gradually. In the present embodiment, when TH2 drops below a predetermined temperature T3 (indicated by tb in the Fig.), print state is temporarily suspended, and warm-up state is entered using the temperature control method of the third embodiment. After that, the warm-up is terminated, upon which multi-printing is resumed (at time indicated by tc).

In the present embodiment also, as in the third embodiment, the temperature of the paper entry guide 22 when multi-printing is resumed is T2, which is higher than the temperature T1 of the paper entry guide 22 at the start of printing in the prior art. Accordingly, if the temperature of the paper entry guide 22 drops excessively because of a large volume of multi-printing, the multi-printing operation can be temporarily suspended to perform warm-up to raise the temperature of the paper entry guide; as a result, the temperature of the paper entry guide 22 recovers and sufficient heat can be transferred to the reverse side of the recording paper, so that the problem of fixing failure does not occur.

A sixth embodiment corresponding to the ninth aspect of the invention will be described below.

Figure 20:
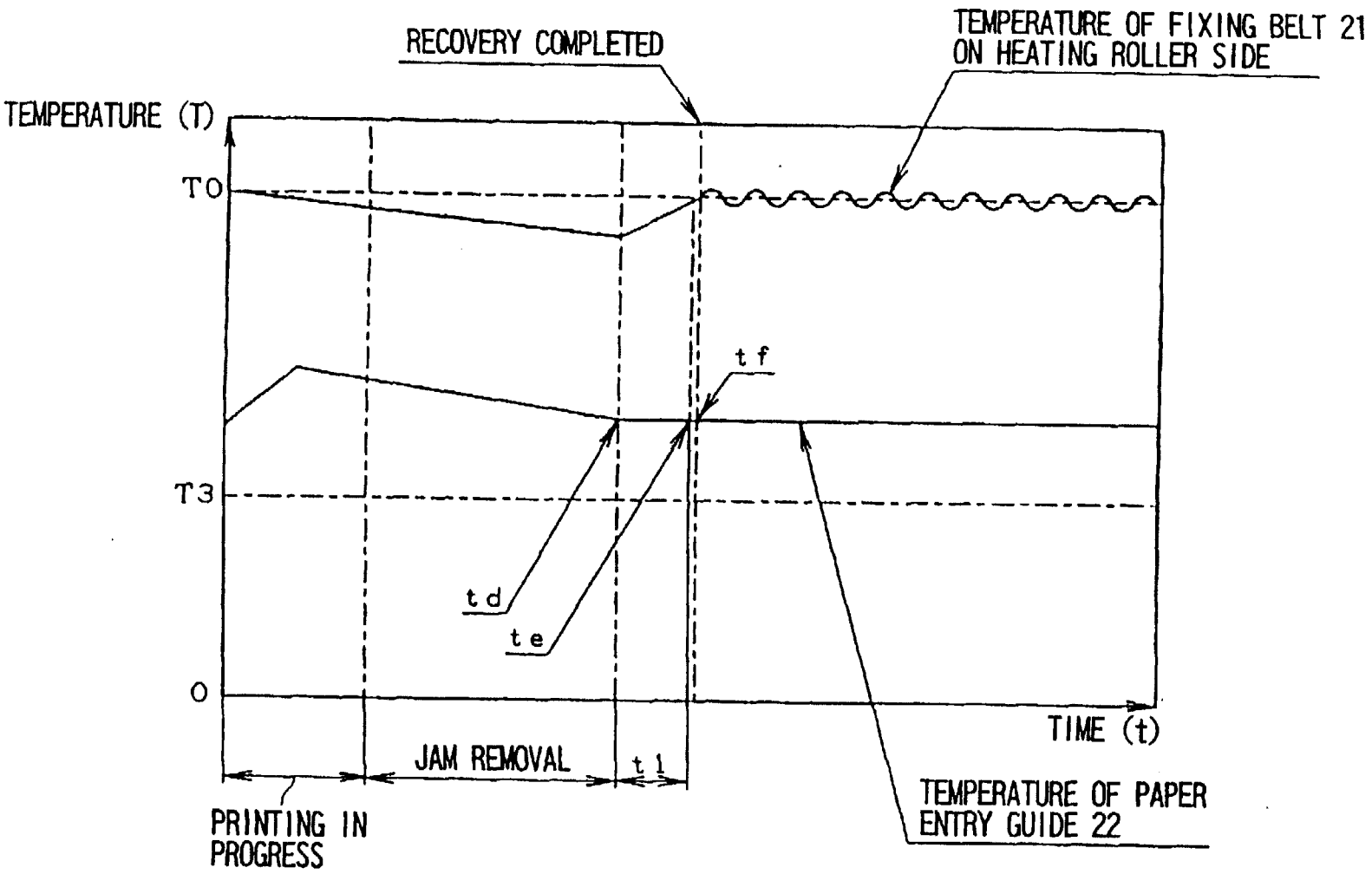
FIG. 20 is a diagram showing the temperature of the fixing belt on the heating roller side and the temperature of the paper entry guide as a function of time during recovery from jamming, corresponding to the sixth embodiment of the present invention.

FIG. 20 shows the temperature of the fixing belt 21 on the heating roller side and the temperature of the paper entry guide 22 as a function of time during a jam recovery process.

When a jam occurs during printing, the printer main body stops its printing operation and indicates to the main body operation section not shown or to a PC that a paper jam has occurred in the main body and the jammed paper needs to be removed. The user removes the jammed paper from the main body as directed.

In the present embodiment, when this process is completed (at time td in the Fig.), the temperature control of the heater lamp 26 is started, and after an elapse of predetermined time t1 (indicated by te in the Fig.), if TH2 is higher than or equal to the predetermined temperature T3, then TH1 is judged immediately, without performing the rotation operation of the fixing belt 21 as described in the third to fifth embodiments, and if $TH1 < T0$, heating is continued, and the recover process is complete when $TH1 \geqq T0$ (at time tf in the Fig.); conversely, if $TH1 \geqq T0$, the recovery process is terminated immediately.

When a jam occurs while the main body is in operation, if the ambient temperature of the main body is low and the temperature inside the machine is low, or if the time from the occurrence of a jam to the removal of jammed paper is long and the temperature of the paper entry guide 22 is allowed to drop, temperature control needs to be performed using the method described in the third or fourth embodiment; on the other hand, in cases where the paper entry guide 22 can maintain a relatively high temperature after removal of jammed paper, if temperature control is performed using the method described in the sixth embodiment, not only the problem of fixing failure does not occur, but the jam recovery time can be shortened.

Figure 21:
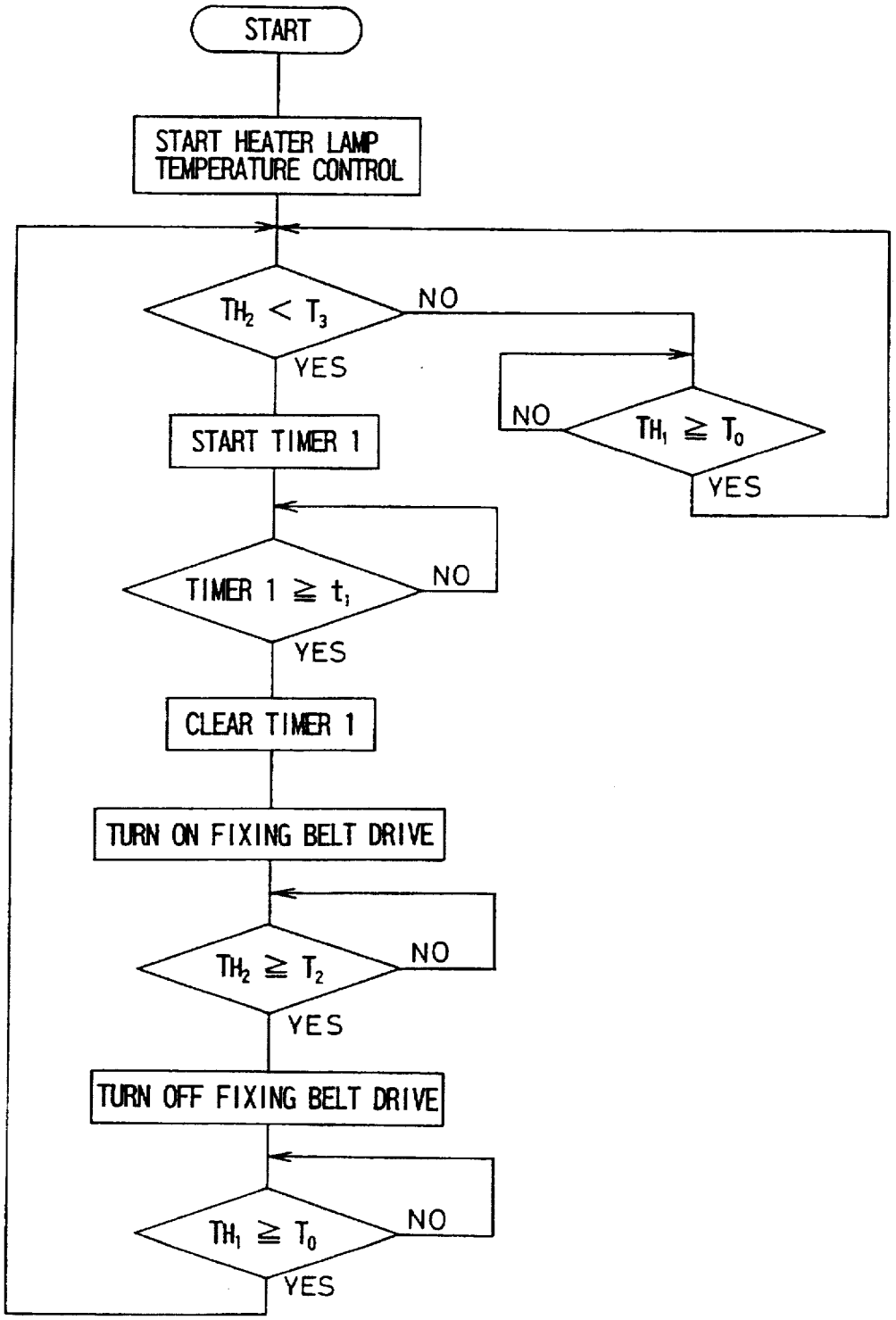
FIG. 21 is a flow chart illustrating the temperature control of a heater lamp corresponding to the third to sixth embodiments of the present invention.
Figure 22:
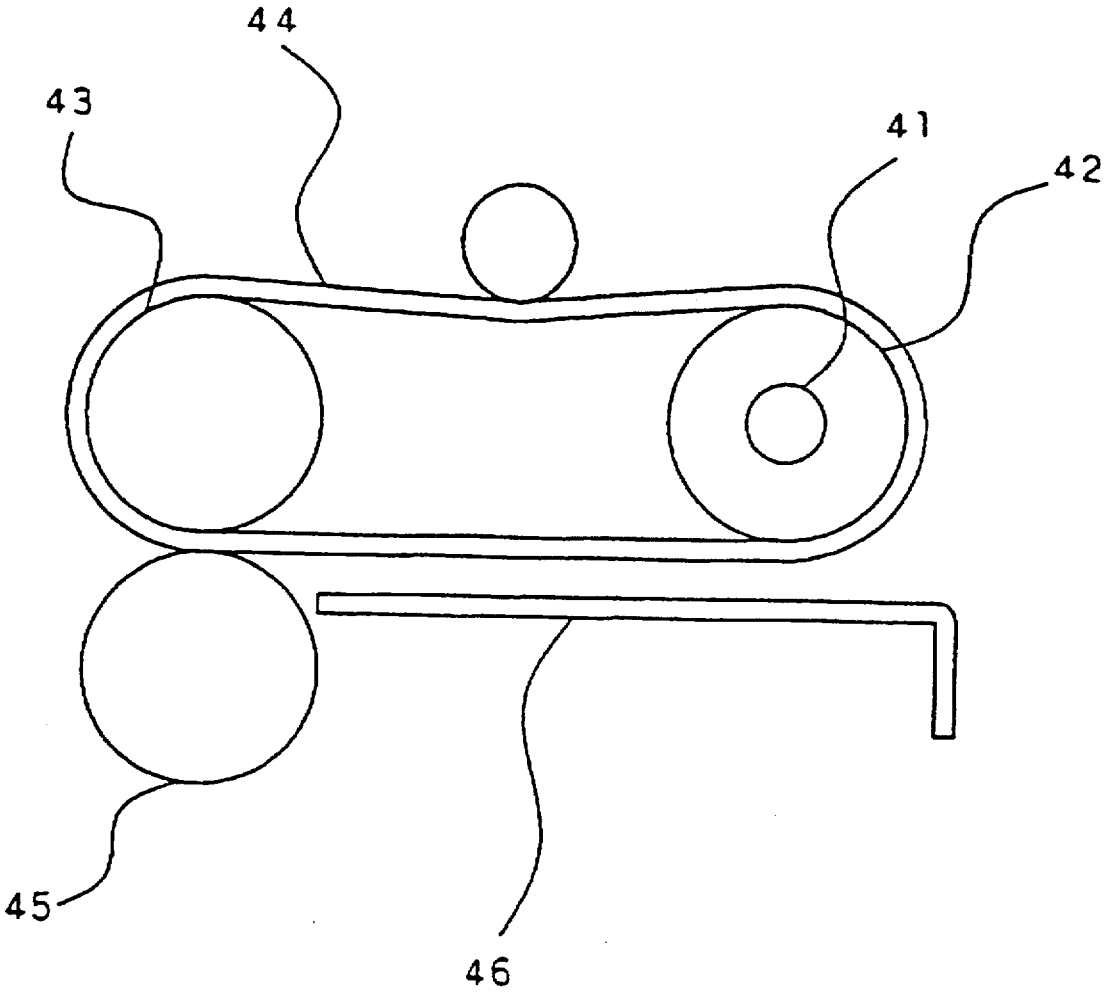
FIG. 22 PRIOR ART
FIG. 22 is a cross-sectional view showing a prior art fixing device.
Figure 23:
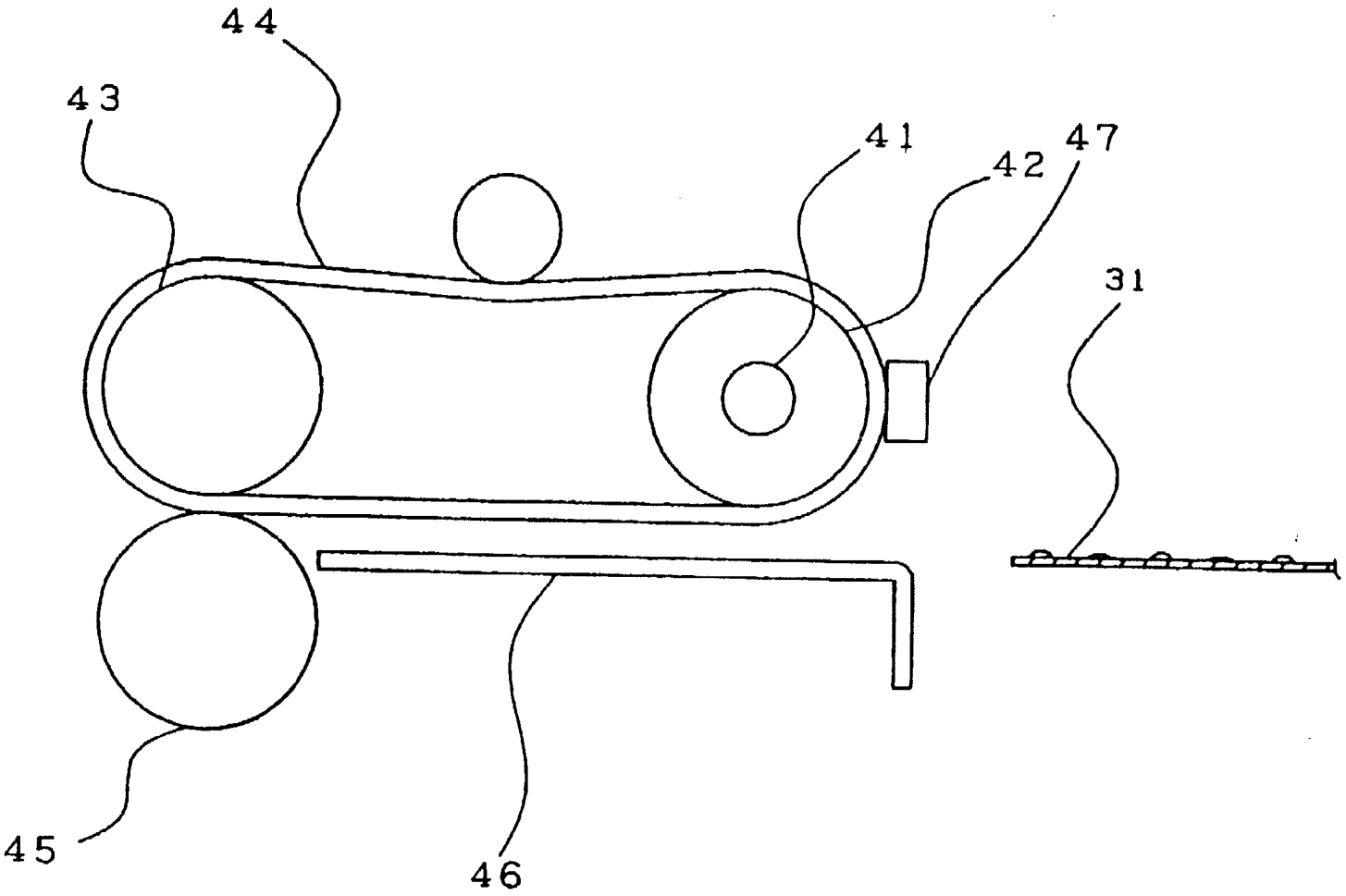
FIG. 23 PRIOR ART
FIG. 23 is a diagram showing a construction of the prior art fixing device.
Figure 24:
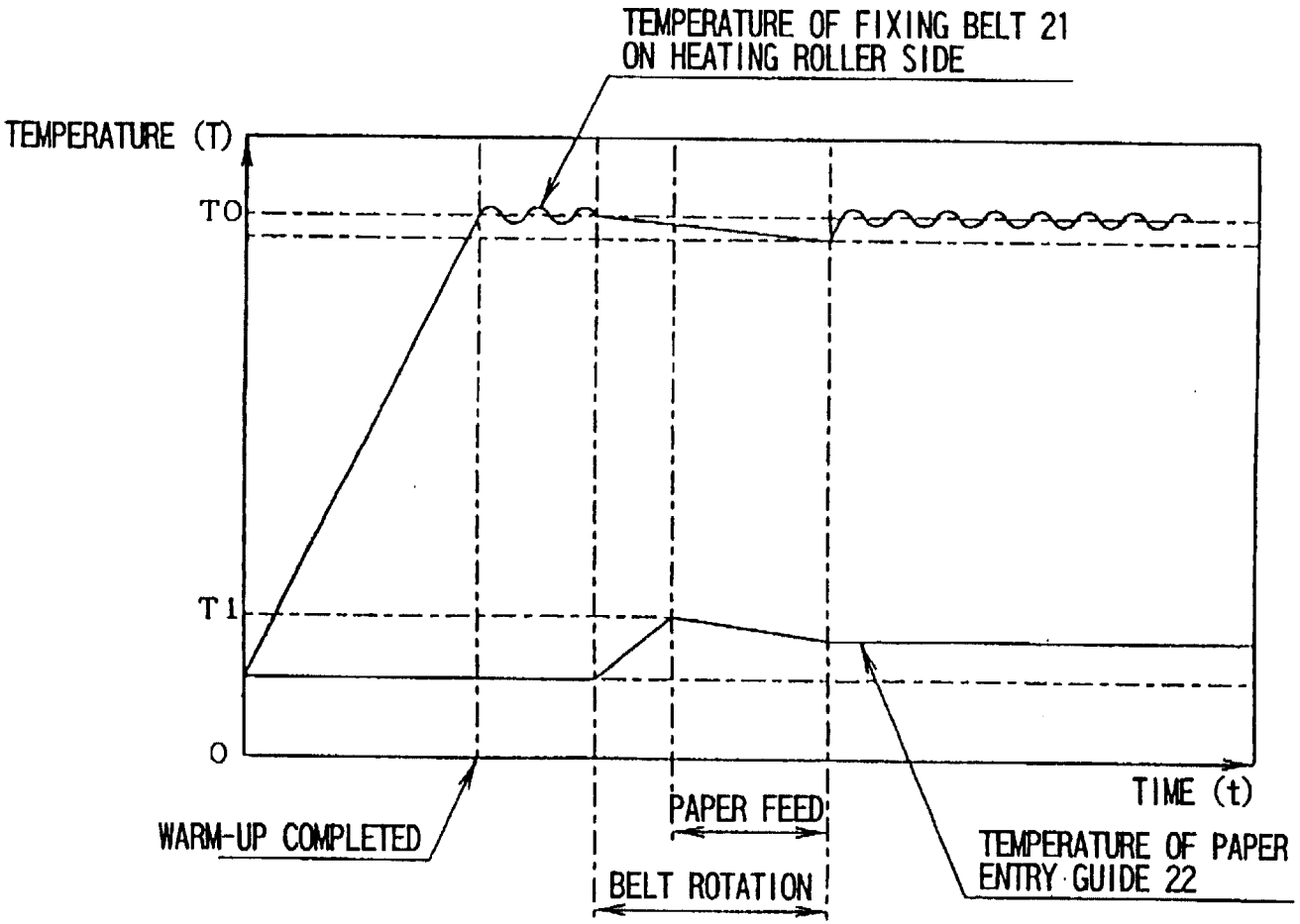
FIG. 24 PRIOR ART
FIG. 24 is a diagram showing the temperature of the fixing belt on the heating roller side and the temperature of the paper entry guide as a function of time during warm-up from main body power on, according to the prior art.

FIG. 21 shows a flow chart illustrating the operation of the examples described in the third to sixth embodiments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a heating roller for heating recording paper onto which a toner image has been transferred;

a fixing roller for fixing the toner image to the recording paper heated by the heating roller;

an endless fixing belt stretched around the heating roller and the fixing roller;

a pressing roller for pressing the recording paper by sandwiching the same against the fixing roller via the fixing belt; and a paper entry guide disposed below and in close proximity to the fixing belt and on the upstream side, as viewed along a transport direction of the recording paper of a nipping portion composed of the fixing roller and the pressing roller, wherein the paper entry guide is mounted in a movable fashion, and paper entry guide moving means is provided for moving the paper entry guide to a position separated from the fixing belt when the recording paper enters the fixing device.

2. The fixing device of claim 1, wherein a recording paper detection sensor, disposed in a transport path upstream of the paper entry guide, for detecting the recording paper is provided, and the paper entry guide moving means is provided for moving the paper entry guide away from the fixing belt when the recording paper detection sensor detects the recording paper, and for moving the paper entry guide back to its initial position in close proximity to the fixing belt when a predetermined time has elapsed after the detection of the recording paper.

3. A fixing device comprising:

a heating roller for heating recording paper onto which a toner image has been transferred;

a fixing roller for fixing the toner image to the recording paper heated by the heating roller;

an endless fixing belt stretched around the heating roller and the fixing roller;

a pressing roller for pressing the recording paper by sandwiching the same against the fixing roller via the fixing belt; and a paper entry guide disposed below and in close proximity to the fixing belt and on the upstream side, as viewed along a transport direction of the recording paper of a nipping portion composed of the fixing roller and the pressing roller, wherein the paper entry guide is mounted in a movable fashion, and paper entry guide moving means is provided for holding the paper entry guide in contact with the fixing belt when the fixing belt is in a stopped condition, and for moving the paper entry guide to a position separated from the fixing belt when the recording paper enters the fixing device.

4. The fixing device of claim 1 or 3, wherein the paper entry guide is separated from the fixing belt when the recording paper is jammed.

5. A fixing temperature control system for a belt type fixing device which comprises:

a heating roller for heating recording paper onto which a toner image has been transferred;

a fixing roller for fixing the toner image to the recording paper heated by the heating roller;

an endless fixing belt stretched around the heating roller and the fixing roller;

a pressing roller for pressing the recording paper by sandwiching the same against the fixing roller via the fixing belt; and a paper entry guide disposed belong and in close proximity to the fixing belt and on the upstream side, as viewed along a transport direction of the recording paper of a nipping portion composed of the fixing roller and the pressing roller, wherein one of two temperature sensing elements is arranged at a position contacting the fixing belt on the heating roller side and the other temperature sensing element is arranged at a position contacting an underside of the paper entry guide, the two temperature sensing elements to control the temperature at which the toner is fixed to the recording paper.

6. A fixing temperature control method for a belt type fixing device which is comprised of a heating roller, a fixing roller, an endless fixing belt stretched around the heating roller and the fixing roller, a pressing roller, a paper entry guide and two temperature sensing elements wherein one of the two temperature sensing elements is arranged at a position contacting the fixing belt on a heating roller side of the fixing belt and the other temperature sensing element is at a position contacting an underside of the paper entry guide, the fixing temperature control method includes the following steps:

heating a recording paper onto which a toner image has been transferred, fixing the toner image to the recording paper which has been heated by the heating roller;

pressing the recording paper by sandwiching the recording paper against the fixing roller through the fixing belt with the help of the pressing roller;

guiding the recording paper by use of a paper entry guide disposed below and in close proximity to the fixing belt and on the upstream side, as viewed along a transport direction of the recording paper of a nipping position composed of the fixing roller and the pressing roller; and, using the temperatures sensed by the temperature sensing elements to control the temperature at which the toner image is fixed to the recording paper.

7. The fixing temperature control method of claim 6 comprising the steps of:

starting a temperature control of a heater lamp to heat the heating roller, when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, determining warm up is complete;

otherwise continuing the heating until the predetermined temperature is reached to complete warm up, wherein an ON-OFF control of the heater lamp is performed according to the temperature detected by the sensing element disposed on the heating roller side.

8. The fixing temperature control method of claim 6 comprising the steps of:

constantly monitoring a temperature of the paper entry guide by the temperature sensing element disposed on the underside of the paper entry guide, under a waiting state of a printer main body; and in the case where the temperature drops below a predetermined temperature, starting a temperature control of a heater lamp when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, completing warm-up;

otherwise continuing the heating until the predetermined temperature is reached to complete warm up, wherein an ON-OFF control of the heater lamp is performed according to the temperature detected by the sensing element disposed on the heating roller side.

9. The fixing temperature control method of claim 6 comprising the steps of:

when the main body is operating in a multi-printing mode, constantly monitoring a temperature of the paper entry guide by the temperature sensing element disposed on the underside of the paper entry guide; and in the case where the temperature drops below a predetermined temperature, suspending the printing operation and starting a temperature control of a heater lamp when the fixing belt is under a stopped condition, the temperature control including:

after an elapse of a predetermined time from starting of the temperature control, starting rotation of the fixing belt;

detecting the temperature of the paper entry guide by means of the temperature sensing element disposed on the underside of the paper entry guide;

when the temperature reaches a predetermined temperature, stopping the rotation of the fixing belt; and when, at that time, the temperature detected by the temperature sensing element disposed on the heating roller side is not less than a predetermined temperature, completing warm-up;

otherwise continuing the heating until the predetermined temperature is reached to complete warm up, wherein an ON-OFF control of the heater lamp is performed according to the temperature detected by the sensing element disposed on the heating roller side.

10. The fixing temperature control method of claim 6, wherein a temperature control during jam recovery comprises the steps of:

starting a temperature control of a heater lamp while holding the fixing belt in the stopped condition, the temperature control including:

after an elapse of a predetermined time, detecting the temperature of the paper entry guide by the temperature sensing element disposed on the underside of the paper entry guide;

when the detected temperature reaches a predetermined temperature, and when, at that time, the temperature detected by the temperature sensing element disposed on the heating roller side is no less than a predetermined temperature, completing the recovery;

otherwise continuing heating until the predetermined temperature is reached to complete recovery, wherein ON-OFF control of the heater lamp is performed according to the temperature detected by the sensing element disposed on the heating roller side.

* * * * *